US011392070B2

(12) United States Patent
Sakurai

(10) Patent No.: US 11,392,070 B2
(45) Date of Patent: Jul. 19, 2022

(54) DRIVING-FORCE-TRANSMITTING MECHANISM AND IMAGE FORMING APPARATUS

(71) Applicant: FUJIFILM Business Innovation Corp., Tokyo (JP)

(72) Inventor: Masami Sakurai, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/224,149

(22) Filed: Apr. 7, 2021

(65) Prior Publication Data

US 2022/0091554 A1 Mar. 24, 2022

(30) Foreign Application Priority Data

Sep. 24, 2020 (JP) ..... JP2020-159392

(51) Int. Cl.
*G03G 15/00* (2006.01)
*G03G 21/18* (2006.01)

(52) U.S. Cl.
CPC ..... *G03G 15/757* (2013.01); *G03G 21/186* (2013.01); *G03G 2221/1657* (2013.01)

(58) Field of Classification Search
CPC ..... G03G 15/757; G03G 21/186; G03G 2221/1657
See application file for complete search history.

(56) References Cited

U.S. PATENT DOCUMENTS

| | | | | |
|---|---|---|---|---|
| 8,194,255 | B2 * | 6/2012 | Andoh | H04N 1/00554 399/379 |
| 9,235,183 | B2 * | 1/2016 | Ueno | G03G 21/1676 |
| 9,804,554 | B2 | 10/2017 | Hatano | |
| 10,001,744 | B2 * | 6/2018 | Araishi | G03G 21/1666 |
| 10,054,904 | B1 * | 8/2018 | Wen | G03G 21/1857 |
| 10,394,183 | B2 * | 8/2019 | Ao | G03G 21/1633 |
| 2006/0260902 | A1 | 11/2006 | Marumoto et al. | |
| 2009/0123181 | A1 * | 5/2009 | Ito | G03G 21/1647 399/167 |
| 2013/0302066 | A1 * | 11/2013 | Kawai | G03G 15/757 399/167 |
| 2020/0168886 | A1 * | 5/2020 | Sato | H01M 10/0525 |

FOREIGN PATENT DOCUMENTS

| | | |
|---|---|---|
| JP | 2006350285 | 12/2006 |
| JP | 2010-032742 | 2/2010 |
| JP | 2016126152 | 7/2016 |

* cited by examiner

*Primary Examiner* — Francis C Gray
(74) *Attorney, Agent, or Firm* — JCIPRNET

(57) ABSTRACT

A driving-force-transmitting mechanism includes a driving-force-transmitting component that transmits a driving force from an apparatus body to an attaching object, the attaching object being attachable to and detachable from the apparatus body; and plural operating components that enables or disables the transmission of the driving force from the apparatus body to the attaching object when the attaching object is attached to or detached from the apparatus body, the operating components operating sequentially with delays in such a manner as to move the driving-force-transmitting component in a direction intersecting attaching and detaching directions in which the attaching object is attached to and detached from the apparatus body.

11 Claims, 14 Drawing Sheets

DRIVING-FORCE-TRANSMITTING MECHANISM AND IMAGE FORMING APPARATUS

CROSS-REFERENCE TO RELATED APPLICATIONS

This application is based on and claims priority under 35 USC 119 from Japanese Patent Application No. 2020-159392 filed Sep. 24, 2020.

BACKGROUND

(i) Technical Field

The present disclosure relates to a driving-force-transmitting mechanism and an image forming apparatus.

(ii) Related Art

There are several known apparatuses relating to a driving-force-transmitting mechanism intended for an image forming apparatus or the like, such as those disclosed by Japanese Unexamined Patent Application Publications Nos. 2006-350285, No. 2010-32742, and No. 2016-126152.

The apparatus disclosed by Japanese Unexamined Patent Application Publication No. 2006-350285 includes a coupling member that is slidably fitted on a driving-force input shaft and is rotatable together with the driving-force input shaft to transmit a driving force to a rotation object, an urging component that urges the coupling member toward a first position where the coupling member is coupled to a coupling provided on the rotation object, and a coupling switching component that selectively positions the coupling member between the first position and a second position where the coupling member is decoupled from the rotation object and is retracted toward the driving-force input shaft.

The apparatus disclosed by Japanese Unexamined Patent Application Publication No. 2010-32742 includes a transmission disabling mechanism in which an operating force of attaching or detaching a detachable unit to or from the apparatus causes at least one of a driving coupling and a driven coupling to be tilted with respect to a rotation axis thereof in such a manner as to disable the transmission of a driving force to the other.

The apparatus disclosed by Japanese Unexamined Patent Application Publication No. 2016-126152 includes a body-side coupling that is movable in a direction of a rotation axis thereof. The body-side coupling includes a tapered portion at an end thereof nearer to a unit in the direction of the rotation axis. The diameter of the tapered portion increases toward a side away from the unit in the direction of the rotation axis. The unit includes a disabling member that is movable in a direction intersecting a rotation axis of a unit-side coupling. When the disabling member is moved, the disabling member comes into contact with and slides on the tapered portion of the body-side coupling in such a manner as to retract the body-side coupling from the unit.

SUMMARY

Aspects of non-limiting embodiments of the present disclosure relate to a simpler mechanism of assuredly enabling and disabling the transmission of a driving force than a mechanism including a disabling member that retracts a body-side coupling from a unit by coming into contact with and sliding on a tapered portion of the body-side coupling.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a driving-force-transmitting mechanism including a driving-force-transmitting component that transmits a driving force from an apparatus body to an attaching object, the attaching object being attachable to and detachable from the apparatus body; and a plurality of operating components that enables or disables the transmission of the driving force from the apparatus body to the attaching object when the attaching object is attached to or detached from the apparatus body, the operating components operating sequentially with delays in such a manner as to move the driving-force-transmitting component in a direction intersecting attaching and detaching directions in which the attaching object is attached to and detached from the apparatus body.

BRIEF DESCRIPTION OF THE DRAWINGS

Exemplary embodiments of the present disclosure will be described in detail based on the following figures, wherein.

DETAILED DESCRIPTION

First Exemplary Embodiment

Figure 1:
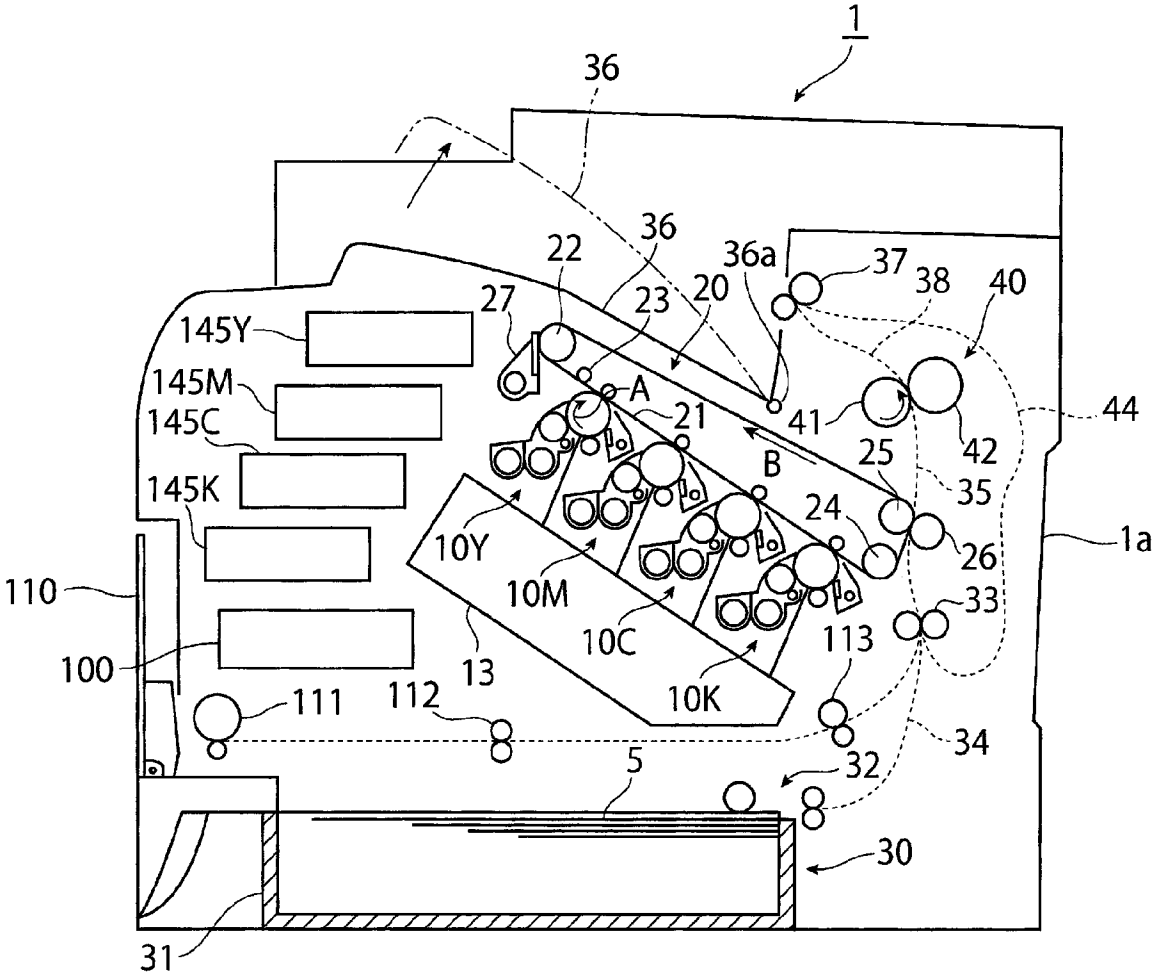
FIG. 1 illustrates an outline of an image forming apparatus to which a driving-force-transmitting mechanism according to a first exemplary embodiment of the present disclosure is applied.
Figure 2:
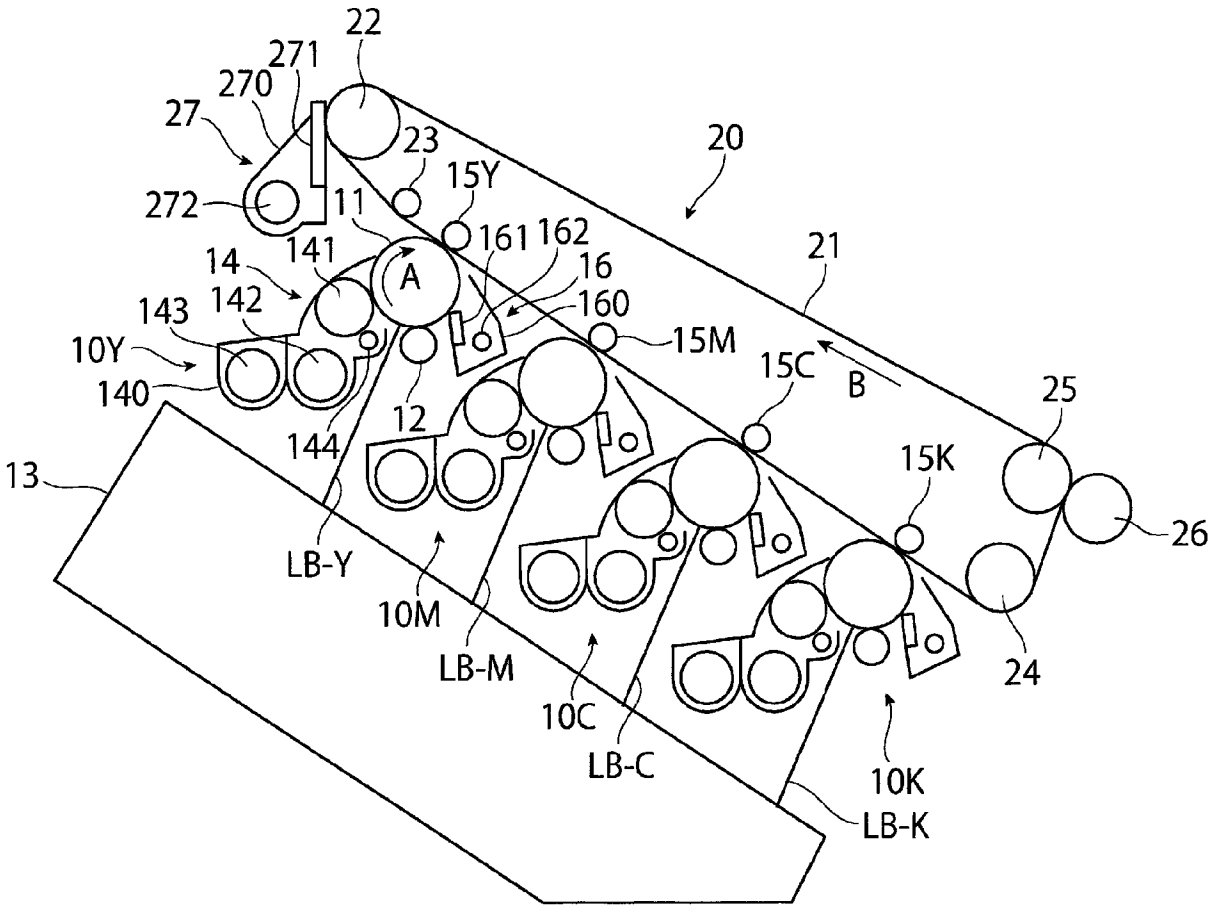
FIG. 2 illustrates an imaging device included in the image forming apparatus.

FIG. 1 illustrates an outline of an image forming apparatus to which a driving-force-transmitting mechanism according to a first exemplary embodiment of the present disclosure is applied. FIG. 2 illustrates an imaging device included in the image forming apparatus.

Outline of Image Forming Apparatus

An image forming apparatus 1 according to the first exemplary embodiment is configured as, for example, a color printer. As illustrated in FIG. 1, the image forming apparatus 1 includes a plurality of imaging devices 10 that form toner images developed with toners contained in developers, an intermediate transfer device 20 as an exemplary intermediate transfer component that carries the toner images formed by the imaging devices 10 and transports the toner images to a second-transfer position where the toner images are eventually second-transferred to a recording sheet 5 as an exemplary recording medium, a sheet feeding device 30 that stores predetermined recording sheets 5 and feeds each of the recording sheets 5 to be supplied to the second-transfer position in the intermediate transfer device 20, a fixing device 40 that fixes the toner images on the recording sheet 5 obtained through second transfer performed by the intermediate transfer device 20, and so forth. The image forming apparatus 1 further includes an apparatus body 1*a*. The apparatus body 1*a* includes supporting members, an exterior covering, and so forth. The broken lines in FIG. 1 represent transport paths along which the recording sheet 5 is transported in the apparatus body 1*a*.

The imaging devices 10 include four imaging devices 10Y, 10M, 10C, and 10K that exclusively form toner images in four respective colors of yellow (Y), magenta (M), cyan (C), and black (K). The four imaging devices 10 (Y, M, C, and K) are arranged in an inclined line in a space provided inside the apparatus body 1*a*.

The four imaging devices 10 are categorized into color imaging devices 10 (Y, M, and C) for yellow (Y), magenta (M), and cyan (C); and a black (K) imaging device 10K. The black imaging device 10K is provided at the downstream-most position in a rotating direction B of an intermediate transfer belt 21 included in the intermediate transfer device 20. The image forming apparatus 1 has the following imaging modes: a full-color mode in which the color imaging devices 10 (Y, M, and C) and the black (K) imaging device 10K are both activated to form a full-color image, and a monochrome mode in which only the black (K) imaging device 10K is activated to form a monochrome image.

Referring to FIG. 2, the imaging devices 10 (Y, M, C, and K) each include a rotatable photoconductor drum 11 as an exemplary image carrier. The photoconductor drum 11 is surrounded by the following devices as exemplary toner-image-forming components: a charging device 12 that charges the peripheral surface (an image carrying surface) of the photoconductor drum 11 on which an image is to be formed to a predetermined potential, an exposure device 13 that applies light generated from image information (a signal) to the charged peripheral surface of the photoconductor drum 11 and thus produces a potential difference to form an electrostatic latent image (for each of the colors), a developing device 14 (Y, M, C, or K) that develops the electrostatic latent image into a toner image with the toner contained in the developer and having a corresponding one of the colors (Y, M, C, and K), a first-transfer device 15 (Y, M, C, or K) as an exemplary first-transfer component that transfers the toner image to the intermediate transfer device 20, a drum cleaning device 16 (Y, M, C, or K) that removes residual matter, such as toner particles, from the image carrying surface of the photoconductor drum 11 having undergone first transfer, and other relevant devices.

The photoconductor drum 11 is obtained by providing a photoconductive layer (photosensitive layer), serving as an image carrying surface, made of a photosensitive material over a cylindrical or columnar base member that is to be grounded. The photoconductor drum 11 is supported in such a manner as to be rotatable in a direction indicated by arrow A when receiving power transmitted from a driving device (not illustrated).

The charging device 12 is a contact-type charging roller positioned in contact with the photoconductor drum 11. The charging device 12 is supplied with a charging voltage. If the developing device 14 employs a reversal development scheme, the charging voltage to be supplied is a voltage or current of a polarity that is the same as the polarity to which the toner to be supplied from the developing device 14 is charged. The charging device 12 may alternatively be a noncontact device such as a scorotron positioned apart from the surface of the photoconductor drum 11.

The exposure device 13 performs polarization scanning in the axial direction of the photoconductor drums 11 with respective laser beams LB-Y, LB-M, LB-C, and LB-K generated from the image information. The exposure device 13 may be a light-emitting-diode (LED) printhead including a plurality of LEDs as light-emitting devices arrayed along the axes of the photoconductor drums 11 to form electrostatic latent images by applying light generated from the image information to the photoconductor drums 11. Employing an LED printhead as the exposure device 13 greatly reduces the size of the exposure device 13.

As illustrated in FIG. 2, the developing devices 14 (Y, M, C, and K) each include a housing 140 having an opening and a developer storage chamber and in which the following are housed: a developing roller 141 that carries and transports the developer to a development area facing the photoconductor drum 11, two stir-transporting members 142 and 143 such as screw augers that transport the developer while stirring the developer and deliver the developer over the developing roller 141, a layer-thickness-regulating member 144 that regulates the amount of developer (the thickness of the developer layer) to be carried by the developing roller 141, and so forth. The developing device 14 is supplied with a developing voltage from a power supply device (not illustrated). The developing voltage is applied to a point between the developing roller 141 and the photoconductor drum 11. The developing roller 141 and the stir-transporting members 142 and 143 each receive power transmitted from a driving device (not illustrated) and thus rotate in a predetermined direction. The developers having the four respective colors (Y, M, C, and K) are each a two-component developer containing a nonmagnetic toner and a magnetic carrier The first-transfer devices 15 (Y, M, C, and K) are each a contact-type transfer device including a first-transfer roller that rotates by being in contact with the periphery of the photoconductor drum 11 with the intermediate transfer belt 21 interposed therebetween and are each supplied with a first-transfer voltage. The first-transfer voltage is a direct-current voltage supplied from a power supply device (not illustrated) and having polarity opposite to the polarity to which the toner is charged.

The drum cleaning devices 16 each include a body 160 as a casing a part of which is open, a cleaning plate 161 pressed with a predetermined pressure against the peripheral surface of the photoconductor drum 11 having undergone first transfer in such a manner as to remove residual matter such as toner particles, a delivering member 162 such as a screw auger that collects the matter such as the toner particles removed by the cleaning plate 161 and delivers the matter to a collecting system (not illustrated), and so forth. The cleaning plate 161 is a plate-shaped member (such as a blade) made of rubber or the like.

Referring to FIG. 1, the intermediate transfer device 20 is positioned above the imaging devices 10 (Y, M, C, and K). Referring to FIG. 2, the intermediate transfer device 20 includes the intermediate transfer belt 21 that rotates in the direction indicated by arrow B while passing through first-transfer positions defined between the photoconductor drums 11 and the respective first-transfer devices 15 (first-transfer rollers), a plurality of belt supporting rollers 22 to 25 that rotatably support the intermediate transfer belt 21 from the inner side of the intermediate transfer belt 21 in such a manner as to retain the intermediate transfer belt 21 in a desired state, a second-transfer device 26 as an exemplary second-transfer component provided at a position on the outer peripheral side (the side on which the image is to be carried) of the intermediate transfer belt 21 supported by the belt supporting roller 25, the second-transfer device 26 second-transferring the toner images on the intermediate transfer belt 21 to a recording sheet 5, and a belt cleaning device 27 that removes residual matter such as toner particles and paper lint from the outer peripheral surface of the intermediate transfer belt 21 at a position past the second-transfer device 26. The second-transfer device 26 is provided on the apparatus body 1*a*.

The intermediate transfer belt 21 is an endless belt made of, for example, synthetic resin such as polyimide resin or polyamide resin in which a resistance regulator or the like such as carbon black is dispersed. The belt supporting roller 22 serves as a driving roller that is rotated by a driving device (not illustrated) as to be described below. The belt supporting roller 23 serves as a surface defining roller that defines the image forming surface of the intermediate transfer belt 21. The belt supporting roller 24 serves as a tension applying roller that applies a tension to the intermediate transfer belt 21. The belt supporting roller 25 serves as a backup roller for second transfer. The belt supporting roller 22 also serves as a counter roller that faces a cleaning plate 271 of the belt cleaning device 27. In the first exemplary embodiment, the belt supporting roller 22 is referred to as driving roller, the belt supporting roller 23 is referred to as surface defining roller, the belt supporting roller 24 is referred to as tension applying roller, and the belt supporting roller 25 is referred to as backup roller.

In the monochrome mode, the surface defining roller 23 is moved to a retracted position where the first-transfer rollers 15 (Y, M, and C) for the colors of yellow (Y), magenta (M), and cyan (C) and the intermediate transfer belt 21 are spaced apart from the color photoconductor drums 11 (Y, M, and C).

The second-transfer device 26 is a contact-type transfer device including a second-transfer roller that rotates by being in contact with the outer peripheral surface of the intermediate transfer belt 21 at the second-transfer position where the intermediate transfer belt 21 is supported by the backup roller 25 of the intermediate transfer device 20. The second-transfer device 26 is supplied with a second-transfer voltage. The second-transfer device 26 or the backup roller 25 of the intermediate transfer device 20 is supplied with a direct-current second-transfer voltage from a power supply device (not illustrated). The second-transfer voltage has polarity opposite to or the same as the polarity to which the toners are charged.

As illustrated in FIG. 2, the belt cleaning device 27 includes a body 270 as a casing a part of which is open, the cleaning plate 271 as an exemplary contact member that is pressed with a predetermined pressure against the peripheral surface of the intermediate transfer belt 21 having undergone second transfer in such a manner as to remove residual matter such as toner particles, a delivering member 272 such as a screw auger that collects the matter such as toner particles removed by the cleaning plate 271 and delivers the matter to a collecting system (not illustrated), and so forth. The cleaning plate 271 is a plate-shaped member (such as a blade) made of rubber or the like.

Referring to FIG. 1, the fixing device 40 includes a housing (not illustrated) having an introduction port and a discharge port for the recording sheet 5 and that houses the following: a heat-applying rotating member 41 in the form of a roller or a belt that rotates in a direction indicated by the arrow and is heated by a heating component such that the surface thereof is kept at a predetermined temperature, and a pressure-applying rotating member 42 in the form of a roller or a belt that is in contact with the heat-applying rotating member 41 with a predetermined pressure over an area extending substantially in the axial direction of the heat-applying rotating member 41 and rotates by following the heat-applying rotating member 41, and so forth. In the fixing device 40, the contact area where the heat-applying rotating member 41 and the pressure-applying rotating member 42 are in contact with each other corresponds to a fixing part where a predetermined fixing process (heating and pressing) is to be performed.

The sheet feeding device 30 is positioned below the imaging devices 10 (Y, M, C, and K). The sheet feeding device 30 includes a single sheet storage 31 (or a plurality of sheet storages 31) that stores a stack of recording sheets 5 of a predetermined size, kind, or the like; and a delivering device 32 that delivers the recording sheets 5 one by one from the sheet storage 31. The sheet storage 31 is attached to the apparatus body 1*a* in such a manner as to be, for example, drawable from the front face (the left side face in FIG. 1) of the apparatus body 1*a* toward which the user of the apparatus body 1*a* faces when operating the apparatus body 1*a*.

The recording sheet 5 is any of the following, for example: thin papers such as plain paper and tracing paper intended for electrophotographic copiers, printers, and the like; over-head-projector (OHP) sheets; and the like. The surface smoothness of the fixed image is improved with the surface smoothness of the recording sheet 5. In this respect, for example, the following may also be employed: coated paper obtained by coating plain paper with resin or the like; thick paper, such as paper for printing art, with a relatively heavy basis weight; and the like.

A sheet feeding path 34 extends between the sheet feeding device 30 and the second-transfer device 26. The sheet feeding path 34 is provided with a single or plurality of pairs of sheet transporting rollers 33 and transporting guides (not illustrated) with which the recording sheet 5 fed from the sheet feeding device 30 is transported to the second-transfer position. The pair of sheet transporting rollers 33 provided immediately before the second-transfer position in the sheet feeding path 34 serves as, for example, a pair of rollers (registration rollers) that adjusts the timing of transporting the recording sheet 5. A sheet transport path 35 extends between the second-transfer device 26 and the fixing device 40. The recording sheet 5 having undergone second transfer and exited from the second-transfer device 26 is transported along the sheet transport path 35 to the fixing device 40. A sheet output path 38 provided with a pair of sheet output rollers 37 extends near a sheet output port provided in the apparatus body 1*a*. The recording sheet 5 having undergone fixing and exited from the fixing device 40 is outputted to a sheet output portion 36 provided at the top of the apparatus body 1*a*.

To improve the ease of handling of the recording sheet 5 outputted to the sheet output portion 36, the sheet output portion 36 is inclined such that, in the direction of output of the recording sheet 5, the downstream end thereof is positioned higher than the upstream end thereof. The intermediate transfer device 20 is inclined along the inclined array of the imaging devices 10 (Y, M, C, and K) in a space provided in the apparatus body 1*a*. Specifically, the intermediate transfer device 20 is inclined such that the side thereof nearer to the yellow (Y) imaging device 10Y is positioned higher than the side thereof nearer to the black (K) imaging device 10K. The sheet output portion 36 is spaced apart by a predetermined distance from a sheet running area defined above the intermediate transfer belt 21 of the intermediate transfer device 20.

The sheet output portion 36 also serves as an upper covering that is opened and closed when the intermediate transfer device 20 is attached to or detached from the apparatus body 1*a*. The sheet output portion 36 is rotatable on a pivot 36*a* defined at the upstream end thereof in the direction of output of the recording sheet 5. When the intermediate transfer device 20 is attached to or detached from the apparatus body 1*a*, the sheet output portion 36 is opened by being rotated upward on the pivot 36*a* as represented by the two-dot chain line in FIG. 1. Normally, the sheet output portion 36 also serving as the upper covering is kept closed by a locking mechanism (not illustrated). The sheet output portion 36 is opened by unlocking the locking mechanism when, for example, the intermediate transfer device 20 is attached to or detached from the apparatus body 1*a*.

A switching gate (not illustrated) that switches the sheet transport path is provided between the fixing device 40 and the pair of sheet output rollers 37. The direction of rotation of the pair of sheet output rollers 37 is switchable between a normal direction (outputting direction) and a reverse direction. To form images on both sides of the recording sheet 5, after the trailing end of the recording sheet 5 having an image on one side thereof goes past the switching gate, the direction of rotation of the pair of sheet output rollers 37 is switched from the normal direction (outputting direction) to the reverse direction. Then, the switching gate switches the transport path, and the recording sheet 5 transported in the reverse direction by the pair of sheet output rollers 37 is transported into a duplex transport path 44 extending substantially vertically along the rear face of the apparatus body 1*a*. The duplex transport path 44 is provided with pairs of sheet transporting rollers (not illustrated), transport guides (not illustrated), and so forth with which the recording sheet 5 having been turned over is transported to the pair of sheet transporting rollers 33.

Referring to FIG. 1, toner cartridges 145 (Y, M, C, and K) as developer containers each extend in a direction orthogonal to the plane of the page and store the developer containing at least the toner to be supplied to a corresponding one of the developing devices 14 (Y, M, C, and K).

A control device 100 illustrated in FIG. 1 generally controls the operation of the image forming apparatus 1. The control device 100 includes a central processing unit (CPU); a read only memory (ROM); a random access memory (RAM); buses connecting the CPU, the ROM, and the like to one another; a communication interface; and so forth.

The apparatus body 1*a* illustrated in FIG. 1 has a manual feed tray 110 openably provided on the front face thereof. One of recording sheets 5 stacked on the manual feed tray 110 opened to extend substantially horizontally is separated from the others and is delivered by a delivering device 111. The recording sheet 5 is then transported by pairs of sheet transporting rollers 112 and 113 to the pair of sheet transporting rollers 33.

Operation of Image Forming Apparatus

A basic image forming operation performed by the image forming apparatus 1 will now be described.

Herein, an operation in the full-color mode will be described in which a full-color image as a combination of toner images in the four respective colors (Y, M, C, and K) is formed by using the four imaging devices 10 (Y, M, C, and K).

When the image forming apparatus 1 receives command information requesting an operation of forming (printing) a full-color image from a device such as a user interface or a printer driver (not illustrated), the four imaging devices 10 (Y, M, C, and K), the intermediate transfer device 20, the second-transfer device 26, the fixing device 40, and other relevant devices are activated.

In the imaging devices 10 (Y, M, C, and K), as illustrated in FIGS. 1 and 2, the photoconductor drums 11 first rotate in the direction indicated by arrow A, and the charging devices 12 charge the surfaces of the photoconductor drums 11 to a predetermined potential of predetermined polarity (in the first exemplary embodiment, negative polarity). Subsequently, the exposure device 13 applies the laser beams LB-Y, LB-M, LB-C, and LB-K to the charged surfaces of the photoconductor drums 11. The laser beams LB-Y, LB-M, LB-C, and LB-K are generated from an image signal obtained through the conversion of image information inputted to the image forming apparatus 1 into pieces of information on the respective color components (Y, M, C, and K). Thus, electrostatic latent images for the respective color components are formed with a predetermined potential difference produced on the surfaces of the photoconductor drums 11.

Subsequently, in the imaging devices 10 (Y, M, C, and K), the toners having the respective colors (Y, M, C, and K) and charged to the predetermined polarity (negative polarity) are supplied from the developing rollers 141 to the electrostatic latent images for the respective color components on the photoconductor drums 11. The electrostatic latent images electrostatically attract the toners and are thus developed. In this developing process, the electrostatic latent images for the respective color components on the respective photoconductor drums 11 are visualized with the toners having the respective colors into toner images having the four respective colors (Y, M, C, and K).

Subsequently, the toner images in the respective colors on the photoconductor drums 11 of the imaging devices 10 (Y, M, C, and K) are transported to the respective first-transfer positions. Then, the first-transfer devices 15 (Y, M, C, and K) first-transfer the toner images in the respective colors to the intermediate transfer belt 21 of the intermediate transfer device 20 such that the toner images are superposed one on top of another, the intermediate transfer belt 21 being rotating in the direction indicated by arrow B.

In the imaging devices 10 (Y, M, C, and K) having undergone first transfer, the drum cleaning devices 16 clean the surfaces of the photoconductor drums 11 by scraping off residual matter adhered to the photoconductor drums 11. Thus, the imaging devices 10 (Y, M, C, and K) are ready for the next imaging operation.

Subsequently, in the intermediate transfer device 20, the intermediate transfer belt 21 carrying the toner images first-transferred thereto rotates and transports the toner images to the second-transfer position. Meanwhile, in the sheet feeding device 30, a predetermined recording sheet 5 is fed into the sheet feeding path 34 synchronously with the imaging operation. In the sheet feeding path 34, the pair of sheet transporting rollers 33 as the pair of registration rollers supplies the recording sheet 5 to the second-transfer position synchronously with the timing of transfer.

At the second-transfer position, the second-transfer device 26 second-transfers the set of toner images on the intermediate transfer belt 21 to the recording sheet 5. In the intermediate transfer device 20 having undergone second transfer, the belt cleaning device 27 removes residual matter such as toner particles from the surface of the intermediate transfer belt 21 having undergone second transfer.

Subsequently, the recording sheet 5 now having the set of toner images second-transferred thereto is released from the intermediate transfer belt 21 and is then transported along the sheet transport path 35 to the fixing device 40. In the fixing device 40, the recording sheet 5 having undergone second transfer is made to pass through the contact area defined between the heat-applying rotating member 41 and the pressure-applying rotating member 42 that are rotating. Thus, the predetermined fixing process (heating and pressing) is performed on the set of unfixed toner images, whereby the set of toner images are fixed to the recording sheet 5. Lastly, if the image forming operation is required for only one side of the recording sheet 5, the recording sheet 5 having undergone fixing is outputted by the pair of sheet output rollers 37 to the sheet output portion 36 at the top of the apparatus body 1*a*.

Through the above process, a recording sheet 5 having a full-color image as a combination of toner images in the four respective colors is outputted.

If only the black (K) imaging device 10K is activated, a recording sheet 5 having a monochrome image is outputted.

Intermediate Transfer Unit

Figure 3:
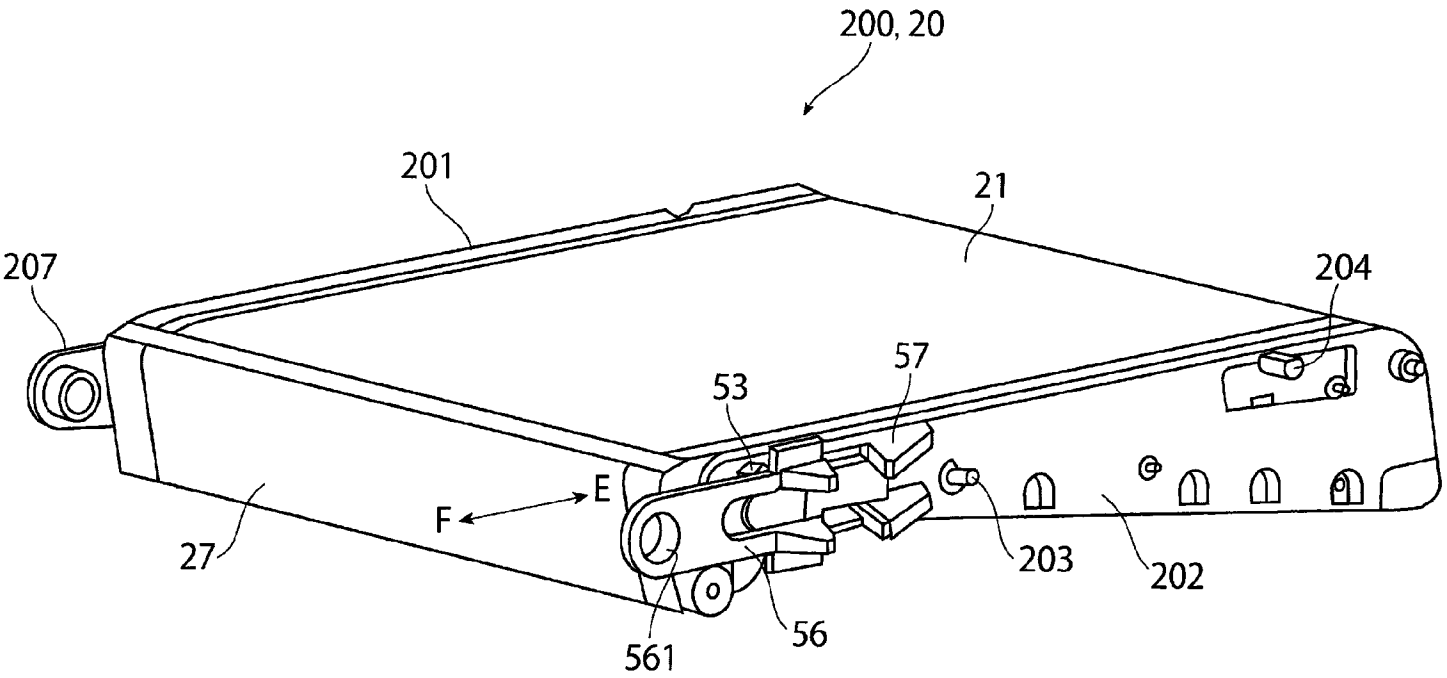
FIG. 3 is a perspective view of an intermediate transfer unit.

Referring to FIG. 3, the intermediate transfer device 20 according to the first exemplary embodiment is regarded as an intermediate transfer unit 200, which is an exemplary attaching object. The intermediate transfer unit 200 is an assembly of various members forming the intermediate transfer device 20 and is independently attachable to and detachable from the apparatus body 1*a* of the image forming apparatus 1.

As illustrated in FIGS. 2 and 3, the intermediate transfer unit 200 includes left and right side frames 201 and 202, by which the driving roller 22, the surface defining roller 23, the tension applying roller 24, and the backup roller 25 are rotatably supported. The left and right side frames 201 and 202 are each a plate-like or frame-like member having a long triangular side-view shape, which is substantially similar to the locus of rotation of the intermediate transfer belt 21. The left and right side frames 201 and 202 are provided with a plurality of guide pins 203, 204, and others. When the intermediate transfer unit 200 is attached to or detached from the apparatus body 1*a*, the guide pins 203, 204, and others position and guide the intermediate transfer unit 200 with reference to guide grooves (not illustrated) provided in the apparatus body 1*a*. The left and right side frames 201 and 202 are integrated with the belt cleaning device 27.

Referring to FIG. 1, when the intermediate transfer unit 200 is set at a predetermined operating position defined in the apparatus body 1*a* of the image forming apparatus 1, a driving force is allowed to be transmitted from the apparatus body 1*a* to the intermediate transfer unit 200. Furthermore, the first-transfer devices 15 (Y, M, C, and K) are allowed to be energized.

Configuration of Driving-Force-Transmitting Mechanism

Figure 4:
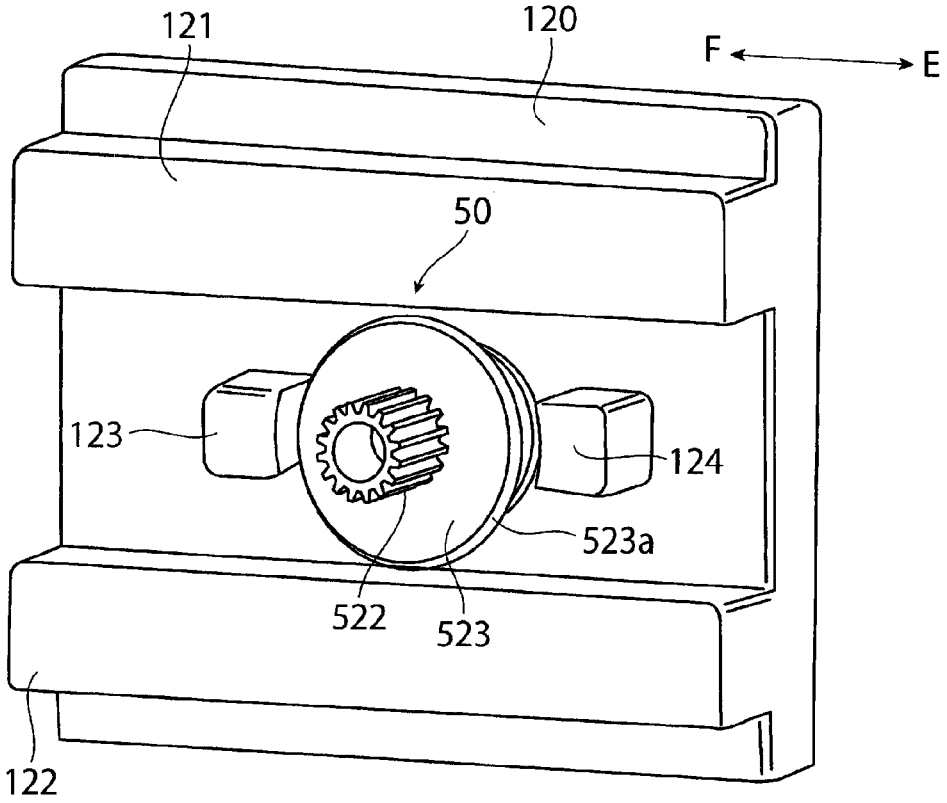
FIG. 4 is a perspective view of the driving-force-transmitting mechanism provided on an apparatus body.

Referring to FIG. 4, the apparatus body 1*a* of the image forming apparatus 1 includes a driving-force-transmitting mechanism 50 at a position corresponding to one axial end of the driving roller 22 of the intermediate transfer unit 200. When the intermediate transfer unit 200 is attached to or detached from the apparatus body 1*a*, the driving-force-transmitting mechanism 50 enables or disables the transmission of the driving force to the driving roller 22 of the intermediate transfer unit 200. Note that part of the driving-force-transmitting mechanism 50 is included in the intermediate transfer unit 200.

Figure 5:
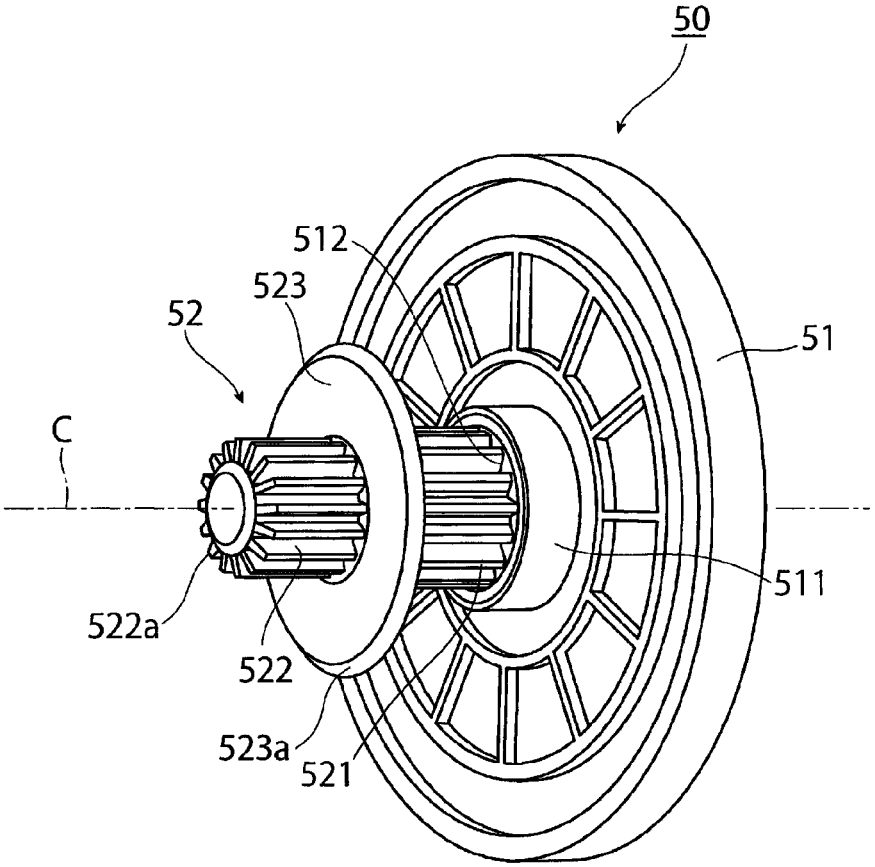
FIG. 5 is a perspective view of an intermediate-transfer-member master coupling.

Referring to FIG. 5, the driving-force-transmitting mechanism 50 includes an intermediate-transfer-member driving gear 51 as an exemplary driving-force-transmitting component (driving gear) provided on the apparatus body 1*a* and that rotates the driving roller 22 of the intermediate transfer unit 200, and an intermediate-transfer-member master coupling 52 as another exemplary driving-force-transmitting component provided on the apparatus body 1*a* and that is movable in an axial direction C of the intermediate-transfer-member driving gear 51.

Referring to FIG. 4, a right frame 120 of the apparatus body 1*a* has a pair of guide portions 121 and 122 on the inner surface thereof. The guide portions 121 and 122 each have a rectangular sectional shape and extend in directions EF in which the intermediate transfer unit 200 is attached and detached (hereinafter referred to as the attaching and detaching directions EF of the intermediate transfer unit 200). The guide portions 121 and 122 extend parallel to each other with the intermediate-transfer-member master coupling 52 of the driving-force-transmitting mechanism 50 positioned therebetween in the vertical direction. Herein, the direction in which the intermediate transfer unit 200 is attached is denoted by E, and the direction in which the intermediate transfer unit 200 is detached is denoted by F.

The right frame 120 of the apparatus body 1*a* further has protecting portions 123 and 124 on the inner surface thereof. The protecting portions 123 and 124 each have a substantially cubic shape and are provided on both sides of the intermediate-transfer-member master coupling 52 in the attaching and detaching directions EF in such a manner as to protect the intermediate-transfer-member master coupling 52. The inner surfaces of the protecting portions 123 and 124 are curved in conformity with the outline of the intermediate-transfer-member master coupling 52. Note that FIG. 4 illustrates only part of the right frame 120 of the apparatus body 1*a*, as a matter of convenience.

Referring to FIG. 5, the intermediate-transfer-member driving gear 51 is an integral body including a cylindrical shaft portion 511 projecting from the center of one side thereof. The intermediate-transfer-member master coupling 52 is fitted to the shaft portion 511 in such a manner as to be movable in the axial direction C on the one side of the intermediate-transfer-member driving gear 51. The intermediate-transfer-member master coupling 52 is an integral body including a cylindrical first gear portion 521 having involute spur gear teeth on the outer periphery thereof, and a cylindrical second gear portion 522 provided at the distal end of the first gear portion 521 and having a smaller outside diameter than the first gear portion 521, the second gear portion 522 having involute spur gear teeth on the outer periphery thereof. The second gear portion 522 includes a tapered part 522*a* at the distal end thereof. The intermediate-transfer-member master coupling 52 further includes a contact portion 523 as an exemplary sliding member having an annular shape with a predetermined outside diameter in such a manner as to project radially outward from a position between the first gear portion 521 and the second gear portion 522. The contact portion 523 may be either integrally included in or separately fixed to the intermediate-transfer-member master coupling 52. The contact portion 523 (hereinafter also referred to as "sliding portion 523") includes a tapered part 523*a* at the outer peripheral end thereof. The tapered part 523*a* is inclined such that the outside diameter increases toward the intermediate-transfer-member driving gear 51 in the thickness wise direction thereof.

Figure 6:
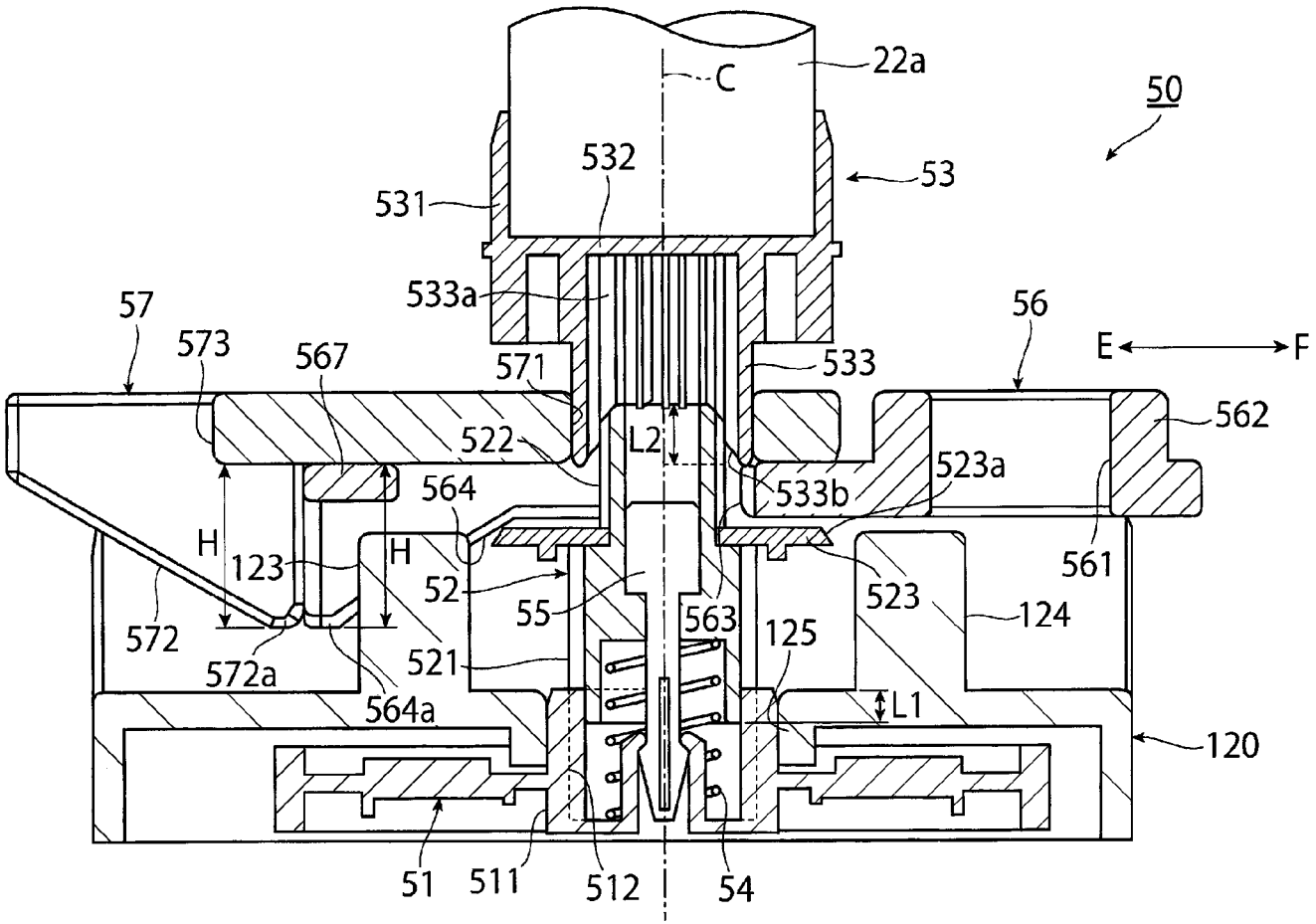
FIG. 6 is a sectional view of the driving-force-transmitting mechanism according to the first exemplary embodiment of the present disclosure.

Referring to FIG. 6, the intermediate-transfer-member driving gear 51 is rotatably supported at the shaft portion 511 thereof by a bearing portion 125 included in the right frame 120 of the apparatus body 1*a*. The intermediate-transfer-member driving gear 51 receives a rotational driving force transmitted thereto through a single or plurality of transmission gears from a driving motor as a drive source (not illustrated) provided in the apparatus body 1*a*.

Referring to FIG. 5, the shaft portion 511 of the intermediate-transfer-member driving gear 51 includes a first internal gear portion 512 forming an involute spur gear that is in mesh with the first gear portion 521 of the intermediate-transfer-member master coupling 52. In a state where the rotational driving force is transmitted to the intermediate-transfer-member master coupling 52 with the first gear portion 521 being in mesh with the first internal gear portion 512 of the intermediate-transfer-member driving gear 51, the intermediate-transfer-member master coupling 52 is movable in the axial direction C. Referring to FIG. 6, the second gear portion 522 of the intermediate-transfer-member master coupling 52 is allowed to come into mesh with (be coupled to) and to be spaced apart from an intermediate-transfer-member slave coupling 53 as an exemplary driving-force-transmitting component provided on the intermediate transfer unit 200. The intermediate-transfer-member slave coupling 53 is provided at one end, in the axial direction C, of the driving roller 22 of the intermediate transfer unit 200.

The intermediate-transfer-member slave coupling 53 includes a coupling body 531 and a third gear portion 533. The coupling body 531 has a cylindrical shape with a relatively large outside diameter and is fixed to a rotating shaft 22*a* of the driving roller 22. The third gear portion 533 extends outward in the axial direction C from a partition 532 provided in the coupling body 531. The third gear portion 533 has a cylindrical shape with a relatively small outside diameter. The third gear portion 533 includes a second internal gear portion 533*a* forming an involute spur gear provided on the inner periphery thereof. The third gear portion 533 includes a tapered part 533*b* at the distal end thereof. The tapered part 533*b* is inclined inward.

The intermediate-transfer-member master coupling 52 and the intermediate-transfer-member slave coupling 53 are not limited to the one including the first and second gear portions 521 and 522 forming involute gears and the one including the third gear portion 533 forming an involute gear. The intermediate transfer belt 21 that is rotated by the driving roller 22 to which the rotational driving force is transmitted through the intermediate-transfer-member master coupling 52 and the intermediate-transfer-member slave coupling 53 is a member that directly affects image quality. Therefore, the rotation accuracy of the intermediate-transfer-member master coupling 52 and the intermediate-transfer-member slave coupling 53 may be as high as possible with less variation in speed and the like. The intermediate-transfer-member master coupling 52 including the first and second gear portions 521 and 522 forming involute gears and the intermediate-transfer-member slave coupling 53 including the third gear portion 533 forming an involute gear are capable of transmitting the rotational driving force to the driving roller 22 with relatively high rotation accuracy.

As illustrated in FIG. 6, the intermediate-transfer-member master coupling 52 is urged in a direction of projection thereof by a coil spring 54 as an exemplary urging component provided between the internal end face of the shaft portion 511 of the intermediate-transfer-member driving gear 51 and the internal end face of the first gear portion 521. The amount of projection of the intermediate-transfer-member master coupling 52 in the axial direction C of the intermediate-transfer-member driving gear 51 is limited by a fixed shaft 55 fixed to the shaft portion 511 of the intermediate-transfer-member driving gear 51. Note that FIG. 6 illustrates a state where the amount of projection of the intermediate-transfer-member master coupling 52 is maximum.

The first gear portion 521 of the intermediate-transfer-member master coupling 52 projecting by the maximum amount is in mesh with the first internal gear portion 512 of the intermediate-transfer-member driving gear 51 by a predetermined meshing length L1 in the axial direction C. Likewise, the second gear portion 522 of the intermediate-transfer-member master coupling 52 projecting by the maximum amount is in mesh with the second internal gear portion 533*a* of the intermediate-transfer-member slave coupling 53 by a predetermined meshing length L2 in the axial direction C. Considering the effective transmission of the driving force from the intermediate-transfer-member driving gear 51 to the intermediate-transfer-member slave coupling 53, the meshing lengths L1 and L2 may each be a certain length or greater. However, if the meshing lengths L1 and L2 are too long, the detaching of the intermediate transfer unit 200 from the apparatus body 1*a* of the image forming apparatus 1 may be hindered.

According to the first exemplary embodiment, as to be described below, the driving-force-transmitting mechanism 50 is configured to assuredly and accurately transmit the rotational driving force from the intermediate-transfer-member driving gear 51 to the intermediate-transfer-member slave coupling 53 and to avoid or prevent the hindrance to the detaching of the intermediate transfer unit 200 from the apparatus body 1*a* of the image forming apparatus 1.

Figure 7:
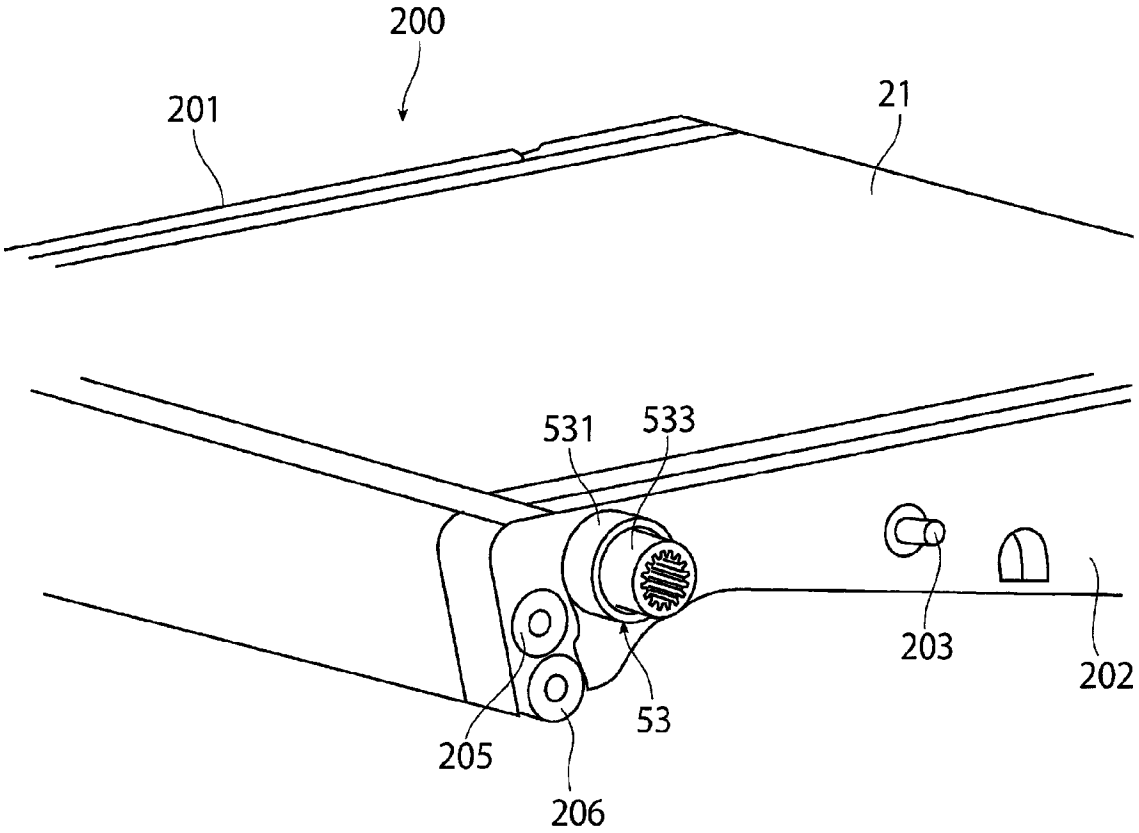
FIG. 7 is a perspective view of relevant part of the intermediate transfer unit.

Referring to FIG. 7, the intermediate transfer unit 200 is provided with the intermediate-transfer-member slave coupling 53 as the driving-force-transmitting component provided on the intermediate transfer unit 200 so as to rotate the driving roller 22. The intermediate-transfer-member slave coupling 53 is provided at one axial end of the driving roller 22, as described above, and projects laterally from the right side frame 202. The intermediate-transfer-member slave coupling 53 is one of the elements of the driving-force-transmitting mechanism 50. The rotational driving force of the intermediate-transfer-member slave coupling 53 is also transmitted to the delivering member 272 (see FIG. 2) of the belt cleaning device 27 through transmission gears 205 and 206 illustrated in FIG. 7. Needless to say, the delivering member 272 of the belt cleaning device 27 may be rotated by another drive source.

Referring to FIG. 6, when the intermediate-transfer-member master coupling 52 moves to project outward (toward the intermediate transfer unit 200) in the axial direction C, the third gear portion 533 of the intermediate-transfer-member slave coupling 53 provided on the intermediate transfer unit 200 comes into mesh with the second gear portion 522 of the intermediate-transfer-member master coupling 52, whereby the transmission of the rotational driving force is enabled. The gear portions such as the first gear portion 521 of the intermediate-transfer-member master coupling 52 and the first internal gear portion 512 of the intermediate-transfer-member driving gear 51 are involute gears, between which backlash of a predetermined degree is provided. Therefore, when the second internal gear portion 533*a* of the intermediate-transfer-member slave coupling 53 and the second gear portion 522 of the intermediate-transfer-member master coupling 52 come into mesh with each other, the second gear portion 522 and the first gear portion 521 of the intermediate-transfer-member master coupling 52 are slightly tilted in the axial direction C with respect to the first internal gear portion 512 of the intermediate-transfer-member driving gear 51. Hence, with the aid of the tapered parts 522*a* and 533*b*, the meshing is achieved smoothly.

The driving-force-transmitting mechanism 50 according to the first exemplary embodiment includes a plurality of operating components. When the intermediate transfer unit 200 is attached to or detached from the apparatus body 1*a* of the image forming apparatus 1, the operating components operate sequentially with delays in such a manner as to move the intermediate-transfer-member master coupling 52 as an exemplary driving-force-transmitting component in the axial direction C intersecting the attaching and detaching directions EF of the intermediate transfer unit 200. Consequently, the transmission of the driving force from the apparatus body 1*a* to the intermediate transfer unit 200 is enabled or disabled.

Figure 8:
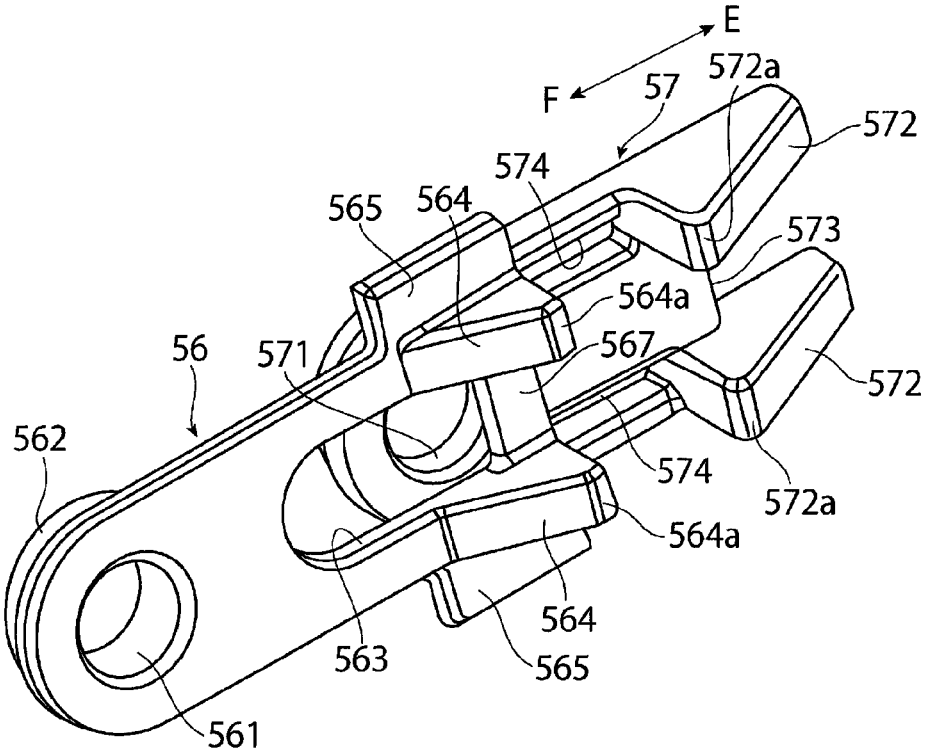
FIG. 8 is a perspective view of a grip member and an operating member.

Specifically, referring to FIGS. 3 and 8, the driving-force-transmitting mechanism 50 according to the first exemplary embodiment includes a grip member 56 as an exemplary first operating component (a first operating member) that is movable in the attaching and detaching directions EF of the intermediate transfer unit 200. The first grip member 56 is provided at the downstream end of the intermediate transfer unit 200 in the detaching direction F (the upstream end in the attaching direction E).

The attaching and detaching directions EF of the intermediate transfer unit 200 literally refer to the directions in which the intermediate transfer unit 200 is attached to and detached from the apparatus body 1*a* of the image forming apparatus 1. Note that the attaching and detaching directions EF of the intermediate transfer unit 200 are not defined to be at a certain angle with respect to the apparatus body 1*a* of the image forming apparatus 1 and are directions in which the intermediate transfer unit 200 moves when attached to or detached from the apparatus body 1*a* of the image forming apparatus 1. In the state where the transmission of the driving force is disabled by the driving-force-transmitting mechanism 50, the attaching and detaching directions EF each vary within a certain range (angle) in the vertical direction.

Figure 9:
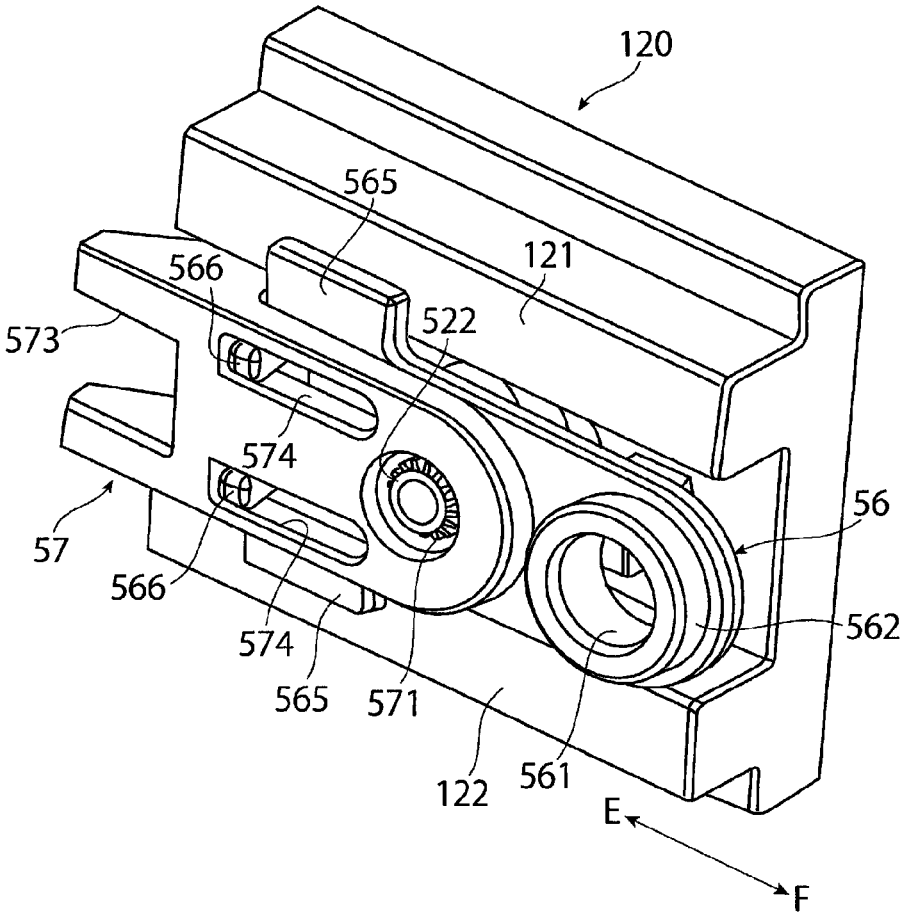
FIG. 9 is a perspective view of the driving-force-transmitting mechanism provided on the apparatus body, with the grip member and the operating member.

The grip member 56 is provided on the right side frame 202 of the intermediate transfer unit 200 with the aid of a supporting member (not illustrated) in such a manner as to be movable in the attaching and detaching directions EF. Referring to FIGS. 8 and 9, the grip member 56 is a flat plate-like member having a substantially rectangular side-view shape with one lengthwise end thereof being semicircular. The grip member 56 includes a grip portion 562 at the one lengthwise end thereof. The grip portion 562 has a short cylindrical shape with an opening 561 into which an operator who is attaching or detaching the intermediate transfer unit 200 inserts his/her finger to grip the grip member 56. Referring to FIG. 3, the left side frame 201 of the intermediate transfer unit 200 is provided with a left grip portion 207 fixed at a position corresponding to the grip member 56. Note that the left grip portion 207 only provides a grip and has a different function from the grip member 56.

Referring to FIGS. 8 and 9, the grip member 56 has an oblong insertion path 563 defined by a substantially U-shaped line in side view at the other lengthwise end thereof opposite the opening 561. The second gear portion 522 of the intermediate-transfer-member master coupling 52 is to be inserted into the insertion path 563 and to move therein in the attaching and detaching directions EF. Furthermore, the grip member 56 includes first sloping portions 564 as exemplary first slopes at the other lengthwise end thereof. The first sloping portions 564 are provided on two respective sides of the insertion path 563 and are spaced apart from each other by a predetermined distance along the front surface of the grip member 56 in a direction intersecting the attaching and detaching directions EF. The predetermined distance is set to a value enough for the insertion of the second gear portion 522 of the intermediate-transfer-member master coupling 52. Each of the first sloping portions 564 starts to project from a position on the front surface (the surface facing the inner surface of the apparatus body 1*a*) of the grip member 56 that is at a predetermined distance from the other lengthwise end, extends at a predetermined angle toward the inner surface of the apparatus body 1*a* up to a summit 564*a* at the other lengthwise end of the grip member 56, and descends from a position past the summit 564*a* in such a manner as to form a vertical surface intersecting the front surface of the grip member 56, thereby forming a substantially right-triangular shape in plan view. The summits 564*a* of the first sloping portions 564 are at a predetermined height H (see FIG. 6) from the back surface (the surface facing the intermediate transfer unit 200) of the grip member 56. The first sloping portions 564 are connected to each other with a connecting portion 567 provided at the other lengthwise end of the grip member 56 and being thinner than the grip member 56.

The grip member 56 further includes rectangular guiding portions 565 at the other lengthwise end thereof. The guiding portions 565 guide the grip member 56 to move in the attaching and detaching directions EF relative to the right frame 120 of the apparatus body 1*a*. The guiding portions 565 each project outward from the respective first sloping portions 564 in a direction intersecting the attaching and detaching directions EF. As illustrated in FIG. 9, the guiding portions 565 come into contact with the pair of guide portions 121 and 122, respectively, provided on the inner surface of the right frame 120 of the apparatus body 1*a*, whereby the grip member 56 is slidable in the attaching and detaching directions EF. The first sloping portions 564 are guided at the outer surfaces thereof by the inner surfaces of the pair of guide portions 121 and 122, respectively, thereby being assuredly movable in the attaching and detaching directions EF.

The driving-force-transmitting mechanism 50 according to the first exemplary embodiment further includes an operating member 57 as an exemplary second operating component (a second operating member). The operating member 57 is moved with a delay from the grip member 56 such that the intermediate transfer unit 200 is detached from the apparatus body 1*a*. The operating member 57 is provided for keeping a state where the transmission of the rotational driving force is disabled over a period from before the intermediate transfer unit 200 starts to be detached from the apparatus body 1*a* until the detaching is complete.

Referring to FIG. 3, the operating member 57 is fixed to the right side frame 202 of the intermediate transfer unit 200 with a fixing component (not illustrated) or is integrated with the right side frame 202.

Referring to FIGS. 8 and 9, the operating member 57 is placed on the back surface (the surface facing the intermediate transfer unit 200) of the grip member 56 in such a manner as to be slidable in the attaching and detaching directions EF. The operating member 57 is a flat plate-like member having a substantially rectangular oblong front-view shape with a predetermined thickness. The operating member 57 has a circular insertion hole 571 at one lengthwise end thereof. The one lengthwise end of the operating member 57 has a semicircular outline similar to the insertion hole 571. Referring to FIG. 6, the intermediate-transfer-member slave coupling 53 provided on the intermediate transfer unit 200 is inserted into the insertion hole 571 of the operating member 57. The intermediate-transfer-member slave coupling 53 provided on the intermediate transfer unit 200 may be fixed in the insertion hole 571 of the operating member 57.

Referring to FIG. 8, the operating member 57 includes second sloping portions 572 as exemplary second slopes at the other lengthwise end thereof. The second sloping portions 572 are provided on two respective outer sides of the front surface of the operating member 57 in a direction intersecting the attaching and detaching directions EF. The direction of slope of the second sloping portions 572 is opposite to the direction of slope of the first sloping portions 564 of the grip member 56. That is, the first sloping portions 564 of the grip member 56 are each inclined in the attaching direction E such that the upstream side thereof is lower than the downstream side thereof. In contrast, the second sloping portions 572 of the operating member 57 are each inclined in the attaching direction E such that the upstream side thereof is higher than the downstream side thereof.

Each of the second sloping portions 572 starts to project from a position on the front surface (the surface facing the inner surface of the apparatus body 1*a*) of the operating member 57 that is at the other lengthwise end, extends at a predetermined angle toward the inner surface of the apparatus body 1*a* up to a summit 572*a* at a position spaced apart from the other lengthwise end of the operating member 57, and descends from a position past the summit 572*a* in such a manner as to form a vertical surface, thereby forming a substantially right-triangular shape in plan view. The summits 572*a* of the second sloping portions 572 are at a predetermined height H (see FIG. 6) from the front surface (the surface facing the inner surface of the apparatus body 1*a*) of the operating member 57. As described above, the operating member 57 is placed on the back surface of the grip member 56. Therefore, as illustrated in FIG. 6, the summits 564*a* of the first sloping portions 564 of the grip member 56 and the summits 572*a* of the second sloping portions 572 of the operating member 57 are at the same position defined by the respective heights H. Referring to FIG. 8, the operating member 57 has a notch 573 at the other lengthwise end thereof. The notch 573 is provided between the second sloping portions 572 and thus separates the tips of the second sloping portions 572 from each other. The second sloping portions 572 are spaced apart from each other by a predetermined distance along the front surface of the operating member 57 in a direction intersecting the attaching and detaching directions EF. The predetermined distance is equal to the distance between the first sloping portions 564 and is set to a value enough for the insertion of the second gear portion 522 of the intermediate-transfer-member master coupling 52.

Figure 10:
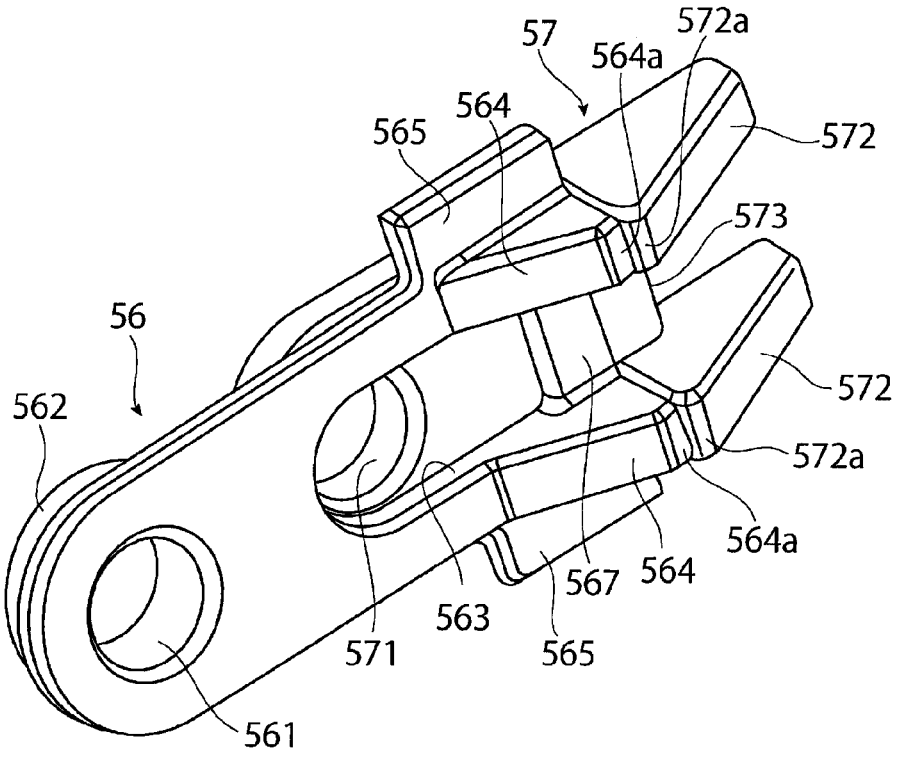
FIG. 10 is another perspective view of the grip member and the operating member.

FIG. 10 is a perspective view of the grip member 56 and the operating member 57, as with FIG. 9, in a state where the intermediate transfer unit 200 has been attached to the apparatus body 1*a* of the image forming apparatus 1.

FIG. 10 illustrates the grip member 56 moved to a rearmost position thereof in the attaching direction E of the intermediate transfer unit 200. In this state, the vertical surfaces of the first sloping portions 564 of the grip member 56 are in contact with the vertical surfaces of the second sloping portions 572 of the operating member 57, respectively.

Referring to FIG. 9, the operating member 57 has grooves 574 extending in the lengthwise direction thereof. The grip member 56 is held in the grooves 574 in such a manner as to be movable in the attaching and detaching directions EF. Specifically, projections 566 provided on the back surface of the grip member 56 are slidably fitted in the respective grooves 574 of the operating member 57.

Referring to FIGS. 8 and 9, when the intermediate transfer unit 200 is attached to or detached from the apparatus body 1*a* of the image forming apparatus 1, particularly when the intermediate transfer unit 200 is detached from the apparatus body 1*a* of the image forming apparatus 1, the operator grips the grip portion 562 of the grip member 56 with his/her finger inserted into the opening 561 and pulls out the grip member 56 in the detaching direction F.

Thus, only the grip member 56 is moved in the detaching direction F with the projections 566 thereof moving along the grooves 574 of the operating member 57. When the projections 566 of the grip member 56 come into contact with the lengthwise ends of the respective grooves 574 of the operating member 57, the operating member 57 starts to move in the detaching direction F with a delay as a period for the projections 566 of the grip member 56 to move in the detaching direction F along the grooves 574 of the operating member 57.

The term "delay" used herein refers to a period of time elapsed from when the grip member 56 starts to move in the detaching direction F until when the operating member 57 starts to move.

The operating member 57 is fixed to the right side frame 202 of the intermediate transfer unit 200. Therefore, when the operating member 57 starts to move in the detaching direction F, both the operating member 57 and the intermediate transfer unit 200 move in the detaching direction F.

The above "delay" has a technical meaning particularly when the intermediate transfer unit 200 is detached from the apparatus body 1*a* of the image forming apparatus 1.

Specifically, at the beginning of the operation of detaching the intermediate transfer unit 200 from the apparatus body 1*a* of the image forming apparatus 1, the intermediate-transfer-member master coupling 52 and the intermediate-transfer-member slave coupling 53 of the driving-force-transmitting mechanism 50 are in mesh with each other.

If the grip member 56 and the operating member 57 are integrated with each other, referring to FIG. 6 for convenience of description, the grip member 56 and the operating member 57 start to move simultaneously, not sequentially with a delay. Accordingly, the first sloping portions 564 of the grip member 56 push down the sliding portion 523 of the intermediate-transfer-member master coupling 52. Therefore, the second gear portion 522 of the intermediate-transfer-member master coupling 52 moves away from the intermediate-transfer-member slave coupling 53.

In the case where the grip member 56 and the operating member 57 are integrated with each other and there is no delay between the movements of the grip member 56 and the operating member 57, the above process proceeds as follows. The intermediate-transfer-member slave coupling 53 fitted in the insertion hole 571 of the operating member 57 integrated with the grip member 56 moves in the detaching direction F. With the movement of the intermediate-transfer-member slave coupling 53 in the detaching direction F, the second gear portion 522 of the intermediate-transfer-member master coupling 52 moves away from the intermediate-transfer-member slave coupling 53 while receiving a pushing force in the detaching direction F exerted by the intermediate-transfer-member slave coupling 53.

That is, if the grip member 56 and the operating member 57 are integrated with each other, the intermediate-transfer-member master coupling 52 moves away from the intermediate-transfer-member slave coupling 53 while being pushed in the detaching direction F by the intermediate-transfer-member slave coupling 53. Such a situation leads to a technical problem that the smooth decoupling of the intermediate-transfer-member master coupling 52 may be hindered.

The problem of hindrance to the smooth decoupling of the intermediate-transfer-member master coupling 52 provided on the apparatus body 1*a* from the intermediate-transfer-member slave coupling 53 provided on the intermediate transfer unit 200 is pronounced particularly if, as described above, the meshing lengths L1 and L2 between the intermediate-transfer-member master coupling 52 and the intermediate-transfer-member slave coupling 53 are set to relatively large values so as to assuredly transmit the rotational driving force from the intermediate-transfer-member master coupling 52 provided on the apparatus body 1*a* to the intermediate-transfer-member slave coupling 53 provided on the intermediate transfer unit 200.

Hence, the driving-force-transmitting mechanism 50 according to the first exemplary embodiment employs the grip member 56 and the operating member 57 that are separate from each other as described above. Moreover, the grip member 56 and the operating member 57 are configured to move sequentially with a delay at the time of attaching or detaching the intermediate transfer unit 200.

To detach the intermediate transfer unit 200 from the apparatus body 1*a* of the image forming apparatus 1, the grip member 56 first causes the intermediate-transfer-member master coupling 52 provided on the apparatus body 1*a* to move away from the intermediate-transfer-member slave coupling 53 provided on the intermediate transfer unit 200, whereby the transmission of the rotational driving force is disabled.

At the beginning of the operation of detaching the intermediate transfer unit 200 from the apparatus body 1*a*, the operating member 57 keeps the state where the intermediate-transfer-member master coupling 52 provided on the apparatus body 1*a* is spaced apart from the intermediate-transfer-member slave coupling 53 provided on the intermediate transfer unit 200, whereby the transmission of the rotational driving force is disabled. Then, the operating member 57 starts to move in the detaching direction F with a delay from the grip member 56. Thus, the intermediate transfer unit 200 is detached from the apparatus body 1*a*, and the operating member 57 restores the state where the intermediate-transfer-member master coupling 52 provided on the apparatus body 1*a* is made to project to enable the transmission of the rotational driving force.

On the other hand, at the beginning of the operation of attaching the intermediate transfer unit 200 to the apparatus body 1*a*, the second sloping portions 572 of the operating member 57 cause the intermediate-transfer-member master coupling 52 provided on the apparatus body 1*a* to move away from the intermediate-transfer-member slave coupling 53 provided on the intermediate transfer unit 200, whereby the transmission of the rotational driving force is disabled.

Then, at the end of the operation of attaching the intermediate transfer unit 200 to the apparatus body 1*a*, the first sloping portions 564 of the grip member 56 move the intermediate-transfer-member master coupling 52 provided on the apparatus body 1*a* to come into mesh with the intermediate-transfer-member slave coupling 53 provided on the intermediate transfer unit 200, whereby the transmission of the rotational driving force is enabled.

In the operation of causing the intermediate-transfer-member master coupling 52 provided on the apparatus body 1*a* to come into mesh with the intermediate-transfer-member slave coupling 53 provided on the intermediate transfer unit 200 in attaching the intermediate transfer unit 200, referring to FIG. 6, the driving-force-transmitting mechanism 50 operates such that the force of pushing down the sliding portion 523 of the intermediate-transfer-member master coupling 52 by the first sloping portions 564 of the grip member 56 is removed. Therefore, even if the grip member 56 and the operating member 57 move simultaneously, no problem arises.

Operation of Driving-Force-Transmitting Mechanism

In the image forming apparatus 1 illustrated in FIG. 1 to which the driving-force-transmitting mechanism 50 according to the first exemplary embodiment is applied, an operation of attaching or detaching the intermediate transfer unit 200 to or from the apparatus body 1*a* of the image forming apparatus 1 is performed in situations such as when the maintenance of the intermediate transfer unit 200 is to be performed or when the intermediate transfer unit 200 is replaced with a new one.

To detach the intermediate transfer unit 200 from the apparatus body 1*a* of the image forming apparatus 1, the sheet output portion 36 also serving as the upper covering provided at the top of the apparatus body 1*a* is opened. To open the sheet output portion 36, the sheet output portion 36 is rotated clockwise on the pivot 36*a* defined at the upstream end thereof in the direction of output of the recording sheet 5, by moving the downstream end thereof in the direction of output of the recording sheet 5.

Referring to FIG. 1, when the sheet output portion 36 is opened, the end of the intermediate transfer unit 200 where the driving roller 22 is provided is exposed to the outside.

Referring to FIG. 3, the operator pulls only the grip member 56 by inserting his/her fingers into the opening 561 of the grip member 56 and into the grip member 207 at the downstream end of the intermediate transfer unit 200 in the detaching direction F.

Figure 11:
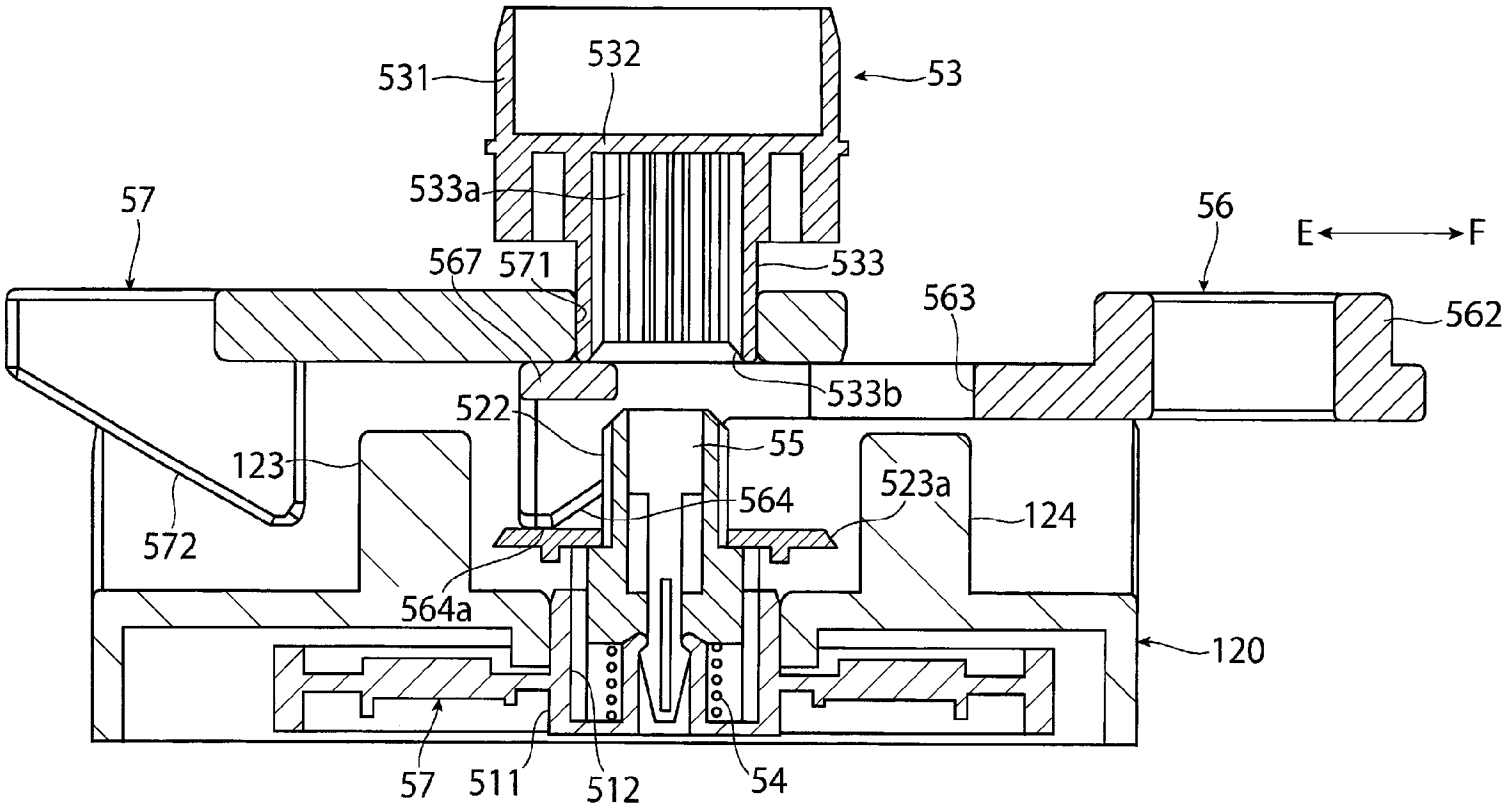
FIG. 11 illustrates how the driving-force-transmitting mechanism according to the first exemplary embodiment of the present disclosure operates.
Figure 12:
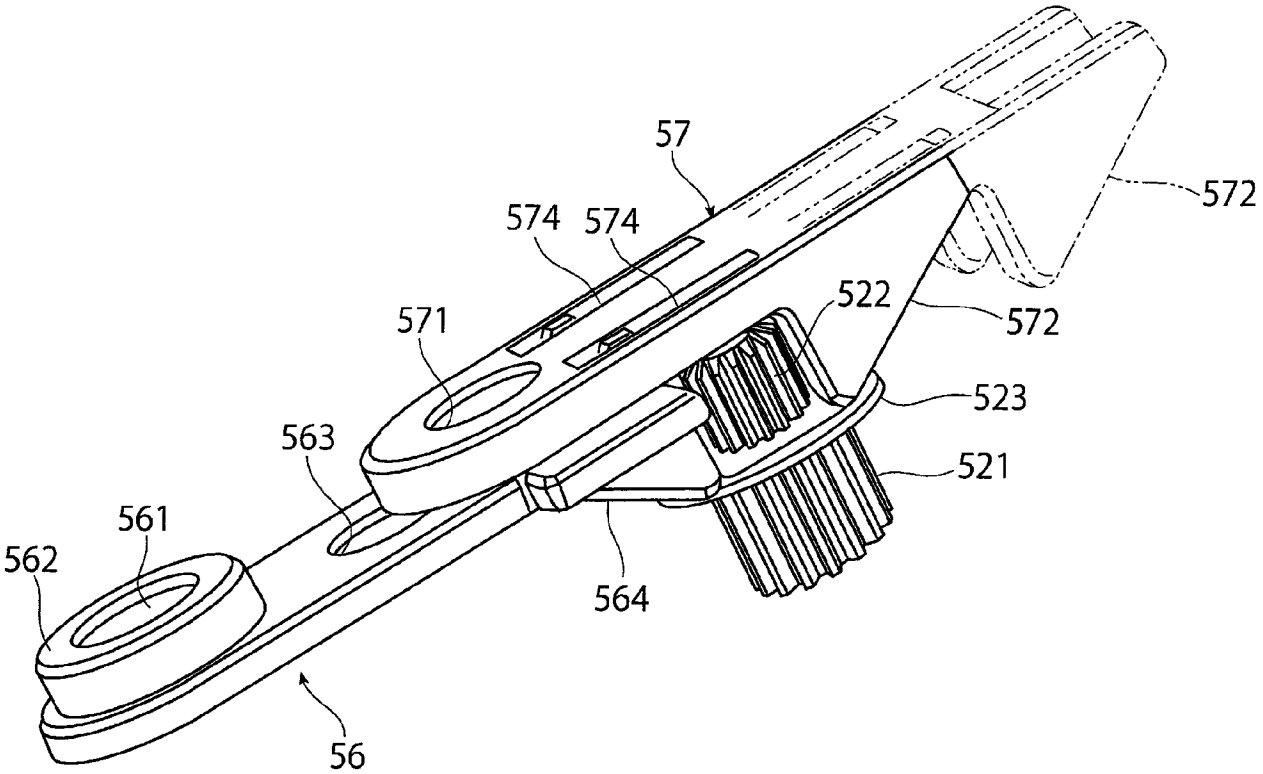
FIG. 12 is yet another perspective view of the grip member and the operating member.

When the operator pulls only the grip member 56, referring now to FIGS. 11 and 12, the first sloping portions 564 of the grip member 56 push down the sliding portion 523 of the intermediate-transfer-member master coupling 52 provided on the apparatus body 1*a*, and the second gear portion 522 of the intermediate-transfer-member master coupling 52 moves away from the third gear portion 533 of the intermediate-transfer-member slave coupling 53 provided on the intermediate transfer unit 200, whereby the transmission of the driving force is disabled.

Subsequently, the operator further pulls the grip member 56 in the detaching direction F. Then, the projections 566 of the grip member 56 come into contact with the ends of the respective grooves 574 of the operating member 57, whereby the operating member 57 is pulled in the detaching direction F. Since the operating member 57 is fixed to the intermediate transfer unit 200, the intermediate transfer unit 200 is also pulled in the detaching direction F.

Referring to FIGS. 11 and 12, the operation of pulling the operating member 57 together with the intermediate transfer unit 200 in the detaching direction F disables the second sloping portions 572 of the operating member 57 from pushing down the sliding portion 523 of the intermediate-transfer-member master coupling 52 provided on the apparatus body 1*a*, whereby the second gear portion 522 of the intermediate-transfer-member master coupling 52 moves in the direction of projection thereof.

On the other hand, when the intermediate transfer unit 200 is attached to the apparatus body 1*a* of the image forming apparatus 1, the operator keeps holding the intermediate transfer unit 200 during the process of setting the intermediate transfer unit 200 into the apparatus body 1*a*.

When the operator moves the intermediate transfer unit 200 into the apparatus body 1*a* in the attaching direction E, the second sloping portions 572 of the operating member 57 fixed to the intermediate transfer unit 200 push down the sliding portion 523 of the intermediate-transfer-member master coupling 52, whereby the second gear portion 522 of the intermediate-transfer-member master coupling 52 moves away from the third gear portion 533 of the intermediate-transfer-member slave coupling 53 provided on the intermediate transfer unit 200.

In this state, the first sloping portions 564 of the grip member 56 may be in contact with the second sloping portions 572 of the operating member 57 as illustrated in FIG. 10. Alternatively, the first sloping portions 564 may be spaced apart from the second sloping portions 572 of the operating member 57 as illustrated in FIG. 12.

While the operation of attaching the intermediate transfer unit 200 to the apparatus body 1*a* is performed, the operator keeps gripping the grip member 56 and the grip member 207 illustrated in FIG. 3. Therefore, the first sloping portions 564 of the grip member 56 are normally in contact with the second sloping portions 572 of the operating member 57.

Subsequently, the operator pushes the intermediate transfer unit 200 to the operating position defined in the apparatus body 1*a*, whereby the movement of pushing down the sliding portion 523 of the intermediate-transfer-member master coupling 52 by using the first sloping portions 564 of the grip member 56 is disabled. Consequently, as illustrated in FIG. 6, the intermediate-transfer-member master coupling 52 provided on the apparatus body 1*a* moves in the direction of projection thereof, and the second gear portion 522 of the intermediate-transfer-member master coupling 52 comes into mesh with the third gear portion 533 of the intermediate-transfer-member slave coupling 53 provided on the intermediate transfer unit 200, whereby the driving-force-transmitting mechanism 50 falls into the state where the transmission of the rotational driving force is enabled.

Thus, in the image forming apparatus 1 to which the driving-force-transmitting mechanism 50 according to the first exemplary embodiment is applied, when the intermediate transfer unit 200 is attached to or detached from the apparatus body 1*a*, particularly when the intermediate transfer unit 20 is detached from the apparatus body 1*a*, the grip member 56 is moved in the detaching direction F of the intermediate transfer unit 200.

When the grip member 56 is moved in the detaching direction F of the intermediate transfer unit 200 to detach the intermediate transfer unit 200 from the apparatus body 1*a*, the first sloping portions 564 of the grip member 56 push down the sliding portion 523 of the intermediate-transfer-member master coupling 52 in such a manner as to move the second gear portion 522 of the intermediate-transfer-member master coupling 52 away from the third gear portion 533 of the intermediate-transfer-member slave coupling 53 provided on the intermediate transfer unit 200, whereby the transmission of the driving force is disabled.

Subsequently, when the intermediate transfer unit 200 is further moved in the detaching direction F from the apparatus body 1*a*, the intermediate transfer unit 200 is detached from the apparatus body 1*a* while the operating member 57 moving with a delay from the grip member 56 keeps disabling the driving-force-transmitting mechanism 50 from transmitting the driving force.

Consequently, in the driving-force-transmitting mechanism 50 according to the first exemplary embodiment, the intermediate-transfer-member master coupling 52 moves away from the intermediate-transfer-member slave coupling 53 without being pushed by the intermediate-transfer-member slave coupling 53 in the detaching direction F.

Second Exemplary Embodiment

Figure 13:
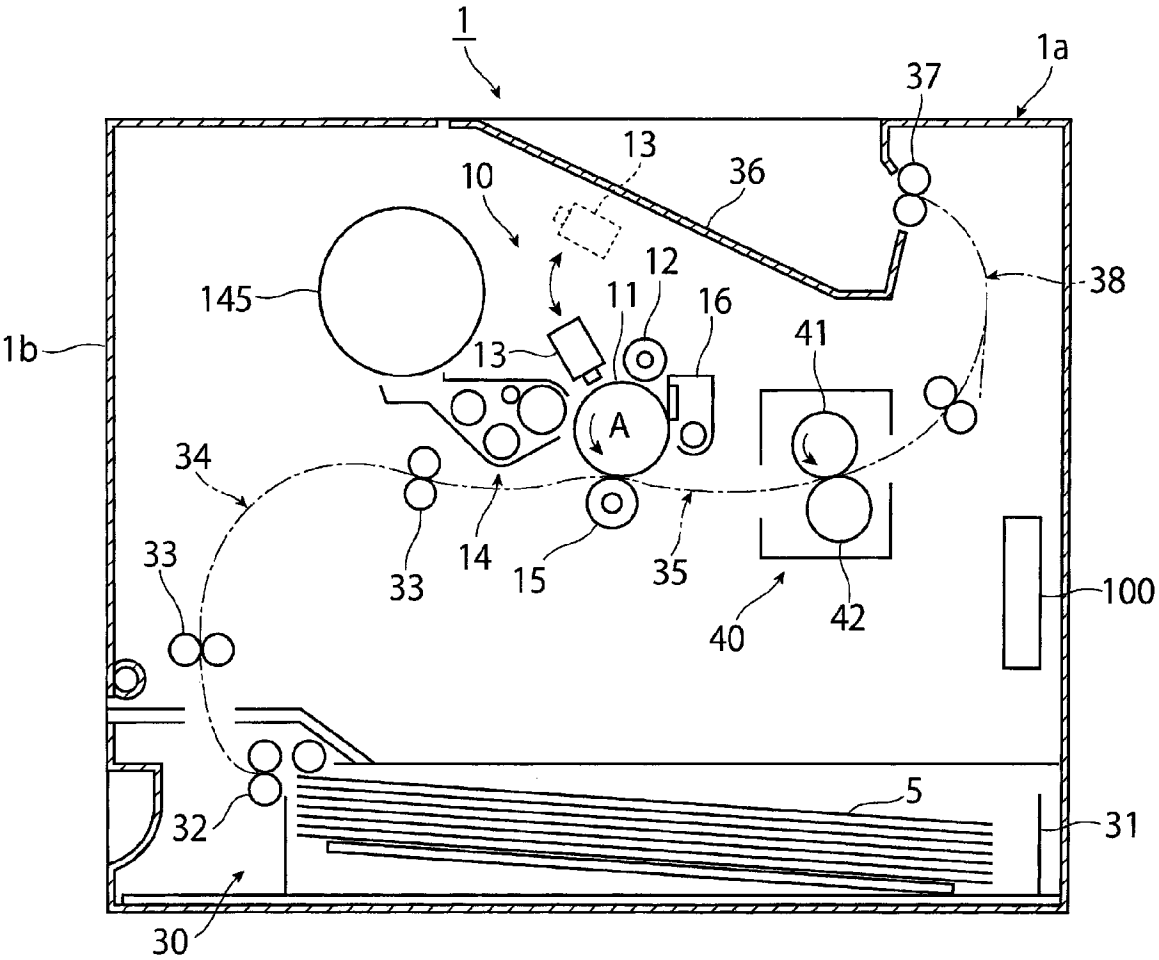
FIG. 13 illustrates an outline of an image forming apparatus to which a driving-force-transmitting mechanism according to a second exemplary embodiment of the present disclosure is applied.

FIG. 13 illustrates an outline of an image forming apparatus to which a driving-force-transmitting mechanism according to a second exemplary embodiment of the present disclosure is applied. Elements that are the same as those of the image forming apparatus according to the first exemplary embodiment are denoted by corresponding ones of the reference numerals used in the first exemplary embodiment, and redundant description of those elements is omitted.

The image forming apparatus to which the driving-force-transmitting mechanism according to the second exemplary embodiment is applied includes an apparatus body, an image forming unit detachably provided on the apparatus body and to be driven by receiving a driving force transmitted from the apparatus body, and the driving-force-transmitting mechanism, which transmits the driving force to the image forming unit from a drive source provided in the apparatus body.

Specifically, referring to FIG. 13, an image forming apparatus 1 to which the driving-force-transmitting mechanism according to the second exemplary embodiment is applied is a monochrome printer including only a monochrome (black) imaging device 10.

Figure 14:
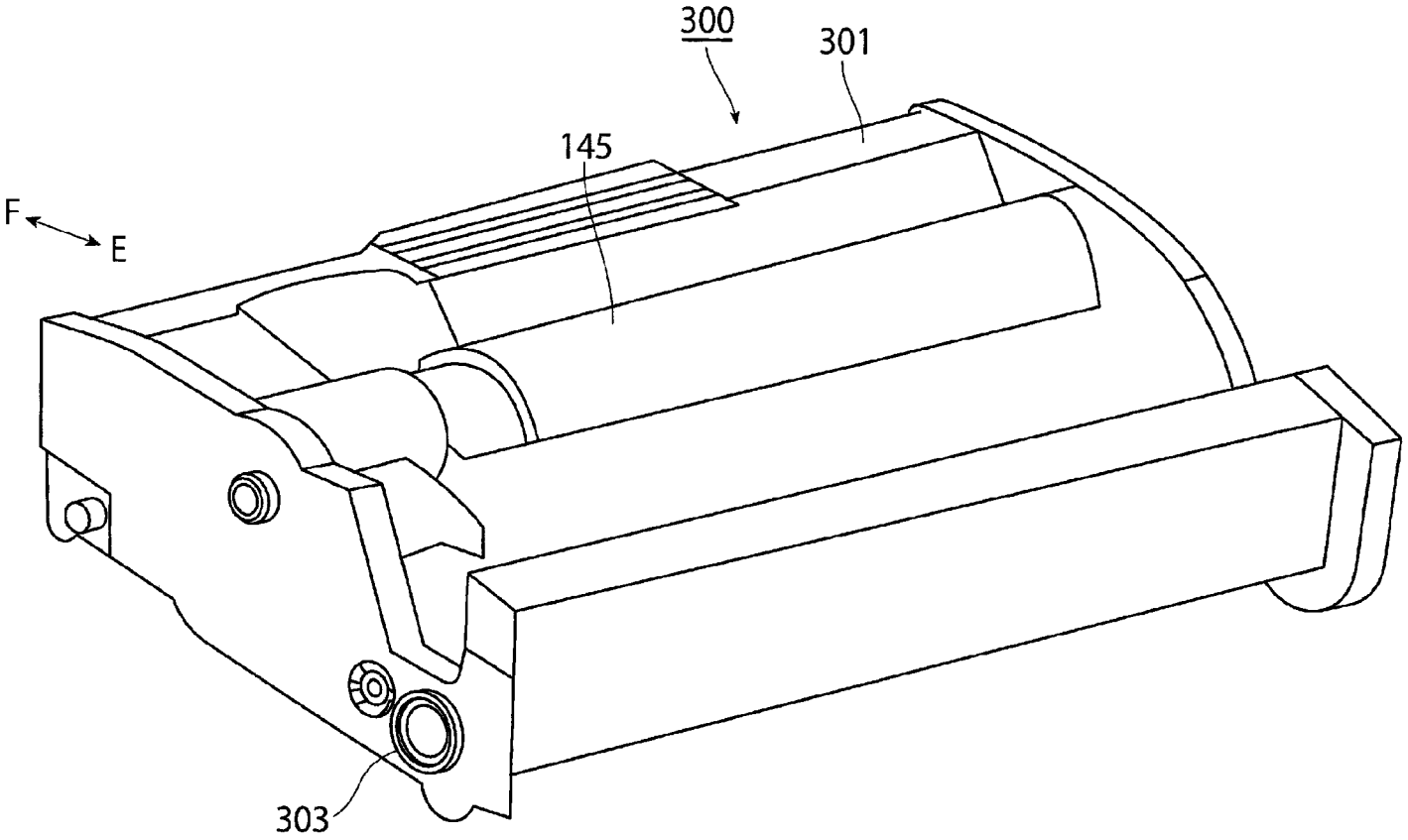
FIG. 14 is a perspective view of an image forming unit included in the image forming apparatus according to the second exemplary embodiment of the present disclosure.

The image forming apparatus 1 includes the monochrome (black) imaging device 10 that forms an image by using a photoconductor drum 11 and toner-image-forming components provided therearound. Referring to FIG. 14, the imaging device 10 is an integral body provided as an image forming unit 300 that includes the photoconductor drum 11, a charging device 12, an exposure device 13, a developing device 14, a drum cleaning device 16, and a toner cartridge 145. The image forming unit 300 is independently attachable to and detachable from an apparatus body 1*a* of the image forming apparatus 1.

Referring to FIG. 13, the image forming unit 300 is attached to or detached from the apparatus body 1*a* with a covering 1*b* provided on the front face (on the left side face in FIG. 13) of the apparatus body 1*a* being open.

As illustrated in FIG. 14, the image forming unit 300 includes a unit body 301, on a side face of which a photoconductor slave coupling 303 that transmits a rotational driving force from the apparatus body 1*a* is provided to rotate the photoconductor drum 11. The photoconductor slave coupling 303 corresponds to the intermediate-transfer-member slave coupling 53 according to the first exemplary embodiment.

The image forming unit 300 is further provided with a grip member 56 and an operating member 57 to be gripped by the operator with his/her fingers hooked thereon when the image forming unit 300 is attached to or detached from the apparatus body 1*a* of the image forming apparatus 1. The grip member 56 and the operating member 57 are provided at the upstream end of the image forming unit 300 in the attaching direction E, i.e., the end nearer to the covering 1*b*. The grip member 56 projects from the upstream end, in the attaching direction E, of the image forming unit 300 so that the operator is allowed to grip the grip member 56 when attaching or detaching the image forming unit 300. The grip member 56 and the operating member 57 have the same configurations as those described in the first exemplary embodiment.

In the image forming apparatus 1 to which the driving-force-transmitting mechanism according to the second exemplary embodiment is applied, the grip member 56 and the operating member 57 operate in the same manner as in the first exemplary embodiment when the image forming unit 300 is attached or detached.

Hence, in the image forming apparatus 1 to which the driving-force-transmitting mechanism according to the second exemplary embodiment is applied, a photoconductor master coupling (not illustrated) moves away from the photoconductor slave coupling 303 without receiving the pushing force in the detaching direction F exerted by the photoconductor slave coupling 303.

The other elements and functions thereof are the same as those described in the first exemplary embodiment, and description of those elements is omitted.

While the first exemplary embodiment concerns a case where the intermediate transfer unit 200 is attached or detached from the side thereof where the driving roller 22 is provided, the side from which the intermediate transfer unit 200 is attached or detached is not limited thereto, of course. The intermediate transfer unit 200 may be attached or detached from the side thereof where the backup roller 25 is provided.

In that case, the rear face, inclusive of the second-transfer roller 26, of the apparatus body 1*a* of the image forming apparatus 1 is to be opened and closed. Furthermore, the grip member 56 and the operating member 57 are provided at a position corresponding to the second-transfer roller 26, and the operation of attaching or detaching the intermediate transfer unit 200 is performed on the rear side of the apparatus body 1*a* of the image forming apparatus 1.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A driving-force-transmitting mechanism comprising:

a driving-force-transmitting component that transmits a driving force from an apparatus body to an attaching object, the attaching object being attachable to and detachable from the apparatus body; and a plurality of operating components that enables or disables the transmission of the driving force from the apparatus body to the attaching object when the attaching object is attached to or detached from the apparatus body, the operating components operating sequentially with delays in such a manner as to move the driving-force-transmitting component in a direction intersecting attaching and detaching directions in which the attaching object is attached to and detached from the apparatus body, wherein the plurality of operating components are configured to move in parallel with each other in the attaching and detaching directions.

2. The driving-force-transmitting mechanism according to claim 1, wherein the plurality of operating components include a first operating component that is moved before the detaching of the attaching object, the first operating component disabling the transmission of the driving force by the driving-force-transmitting component from the apparatus body to the attaching object when the first operating component is moved in the detaching direction in which the attaching object is detached from the apparatus body; and a second operating component that is moved with a delay from the first operating component, the second operating component enabling the disabled transmission of the driving force when the second operating component is moved in the detaching direction.

3. The driving-force-transmitting mechanism according to claim 2, wherein when the attaching object is attached to the apparatus body, the first operating component is moved in the attaching direction in which the attaching object is attached to the apparatus body and the second operating component is moved in the attaching direction with a delay from the first operating component in such a manner as to enable the disabled transmission of the driving force.

4. The driving-force-transmitting mechanism according to claim 1, wherein the plurality of operating components include a first operating member that is movable in the attaching and detaching directions; and a second operating member that is moved by the first operating member in the attaching and detaching directions, and wherein when the attaching object is detached from the apparatus body, the first operating member moves the driving-force-transmitting component to a position where the transmission of the driving force from the apparatus body to the attaching object is disabled and the second operating member is moved by the first operating member to a position where the disabled transmission of the driving force is enabled.

5. The driving-force-transmitting mechanism according to claim 4, wherein the first operating member includes a first slope with which the driving-force-transmitting component is moved to the position where the transmission of the driving force is disabled, the driving-force-transmitting component being urged in a direction in which the transmission of the driving force to the attaching object is enabled.

6. The driving-force-transmitting mechanism according to claim 4, wherein the second operating member includes a second slope with which the driving-force-transmitting component is moved to the position where the transmission of the driving force is disabled, the driving-force-transmitting component being urged in a direction in which the transmission of the driving force to the attaching object is enabled.

7. The driving-force-transmitting mechanism according to claim 4, wherein the second operating member is connected to the first operating member in such a manner as to move in the attaching and detaching directions by following the first operating member with a delay from the first operating member, the delay being a period elapsed for a movement by a predetermined distance.

8. The driving-force-transmitting mechanism according to claim 1, wherein the driving-force-transmitting component includes a driving gear that is provided on the apparatus body and is rotated by a drive source;

a master coupling that rotates together with the driving gear and is movable in a direction intersecting the attaching and detaching directions;

an urging member that urges the master coupling in a direction in which the transmission of the driving force to the attaching object is enabled; and a sliding member that pushes the master coupling in a direction in which the transmission of the driving force to the attaching object is disabled.

9. An image forming apparatus comprising:

an apparatus body;

an intermediate transfer unit that is detachably attached to the apparatus body and is driven by receiving a driving force transmitted from the apparatus body; and a driving-force-transmitting mechanism that transmits the driving force from a drive source provided in the apparatus body to the intermediate transfer unit, wherein the driving-force-transmitting mechanism is the driving-force-transmitting mechanism according to claim 1.

10. An image forming apparatus comprising:

an apparatus body;

an image forming unit that is detachably attached to the apparatus body and is driven by receiving a driving force transmitted from the apparatus body; and a driving-force-transmitting mechanism that transmits the driving force from a drive source provided in the apparatus body to the image forming unit, wherein the driving-force-transmitting mechanism is the driving-force-transmitting mechanism according to claim 1.

11. A driving-force-transmitting mechanism comprising:

a driving-force-transmitting component that transmits a driving force from an apparatus body to an attaching object, the attaching object being attachable to and detachable from the apparatus body; and a plurality of operating components that enables or disables the transmission of the driving force from the apparatus body to the attaching object when the attaching object is attached to or detached from the apparatus body, the operating components operating sequentially with delays in such a manner as to move the driving-force-transmitting component in a direction intersecting attaching and detaching directions in which the attaching object is attached to and detached from the apparatus body, wherein the driving-force-transmitting component comprises a sliding member, and each of the plurality of operating components is configured to push the sliding member in the direction intersecting the attaching and detaching directions.

* * * * *